US007492318B2

(12) United States Patent
Duzdar et al.

(10) Patent No.: US 7,492,318 B2
(45) Date of Patent: Feb. 17, 2009

(54) MOBILE WIDEBAND ANTENNAS

(75) Inventors: Ayman Duzdar, Holly, MI (US); Tan Dinh Quach, Grand Blanc, MI (US)

(73) Assignee: Laird Technologies, Inc., Chesterfield, MO (US)

( * ) Notice: Subject to any disclaimer, the term of this patent is extended or adjusted under 35 U.S.C. 154(b) by 143 days.

(21) Appl. No.: 11/675,498

(22) Filed: Feb. 15, 2007

(65) Prior Publication Data

US 2008/0198077 A1 Aug. 21, 2008

(51) Int. Cl.
*H01Q 1/32* (2006.01)

(52) U.S. Cl. ..... 343/711; 343/713; 343/872

(58) Field of Classification Search ..... 343/711, 343/713, 872

See application file for complete search history.

(56) References Cited

U.S. PATENT DOCUMENTS

| | | | | |
|---|---|---|---|---|
| 6,297,776 | B1 | 10/2001 | Pankinaho | |
| 6,369,761 | B1 | 4/2002 | Thiam et al. | |
| 6,542,123 | B1 | 4/2003 | Chen | |
| 6,717,548 | B2 | 4/2004 | Chen | |
| 7,009,569 | B2 | 3/2006 | Lipka et al. | |
| 7,042,403 | B2 | 5/2006 | Colburn et al. | |
| 7,091,908 | B2 | 8/2006 | Fabrega-Sanchez | |
| 7,091,912 | B2 * | 8/2006 | Iacovella et al. | 343/713 |
| 2003/0025636 | A1 | 2/2003 | Chen | |
| 2003/0076265 | A1 | 4/2003 | Chen | |
| 2004/0116157 | A1 | 6/2004 | Vance et al. | |
| 2005/0233786 | A1 | 10/2005 | Hatch | |
| 2006/0176233 | A1 * | 8/2006 | Tang et al. | 343/850 |
| 2007/0115179 | A1 * | 5/2007 | Tang et al. | 343/700 MS |
| 2007/0247380 | A1 * | 10/2007 | Borleske et al. | 343/719 |

OTHER PUBLICATIONS

E.B. Perri, "Dual band cellular antenna in a multifunction platform for vehicular applications", 2006 IEEE, University of Sao Paulo—Dept. of Telecommunications and Control Engineering Av. Prof. Luciano Gualberto, trav. 3, 158 ZC 05508-900 Sao Paulo, Brazil (2006) pp. 2361-2364.

* cited by examiner

*Primary Examiner*—Tan Ho
(74) *Attorney, Agent, or Firm*—Harness, Dickey & Pierce, P.L.C.

(57) ABSTRACT

In various exemplary embodiments, a wideband antenna assembly includes a stamped monopole antenna mast having two or more conductors combined to a single feed. The conductors are combined at a predetermined height above the point of connection with the single feed. The conductors further have a predetermined spacing between the conductors.

27 Claims, 39 Drawing Sheets

MOBILE WIDEBAND ANTENNAS

FIELD

The present disclosure relates to antennas, and more particularly to wideband monopole antennas for use with mobile platforms, such antennas mountable to automobile or vehicle roofs, hoods, trunk lids, etc.

BACKGROUND

The statements in this section merely provide background information related to the present disclosure and may not constitute prior art.

Communication using cell phones is a growing part of personal telecommunications. Various cellular networks are in place to allow communications between, for example, different cell phone users. However, as cellular communication increases, network providers have developed different standards for operation, typically meaning operation expanded to different radio frequency bands. For example, the Advanced Mobile Phone System (AMPS) operates in the 800 Megahertz (MHz) frequency band. The Global System for Mobile Communications (GSM) generally operates in the 900 MHz and 1800 MHz frequency bands in Europe, but in the 850 MHz and 1900 MHz frequency bands in the United States. The Personal Communications Service (PCS) operates in the 1900 MHz frequency band. The Universal Mobile Telecommunications System (UMTS) operates in the 1900 MHz to 1980 MHz frequency band for uplinks and in the 2110 MHz to 2170 MHz frequency band for downlinks.

Making cellular communication available in automobiles is important. To accomplish this, antenna systems having one or more antennas may be installed to generally flat and/or metallic surfaces of the automobiles (e.g., to the roof, hood, trunk, etc.) for receiving different cellular frequencies and enabling cell phone users to communicate with, for example, other cell phone users. Typically, though, for a user to receive frequencies in more than one frequency band (e.g., based on more than one network standard, etc.), the antenna system includes multiple antennas configured to receive one or more of the desired frequency bands.

SUMMARY

According to various aspects of the present disclosure, exemplary embodiments are provided of stamped monopole wideband antennas suitable for use with mobile platforms. In one exemplary embodiment, a stamped monopole antenna mast having two or more conductors combined to a single feed. The conductors are combined at a predetermined height above the point of connection with the single feed. The conductors further have a predetermined spacing between the conductors.

Another exemplary embodiment provides an antenna assembly for installation to a vehicle body wall operable as an electrically large ground plane for the antenna assembly after installation thereto. The antenna assembly generally includes a stamped metal monopole antenna mast. The antenna mast may include a first conductor tuned to at least one electrical resonant frequency for operating within a bandwidth ranging from about 800 MHz to about 1000 MHz. The antenna mast may also include a second conductor tuned to at least one electrical resonant frequency for operating within a bandwidth ranging from about 1650 MHz to about 2700 MHz. An open slot may extend at least partially between the first and second conductors to provide impedance matching. When the antenna mast is electrically coupled to an electrically large ground plane, the antenna mast has a voltage standing wave ratio (VSWR) of about 2:1 or less at frequencies within a bandwidth ranging from about 800 MHz to about 1000 MHz and at frequencies within a bandwidth ranging from about 1650 MHz to about 2700 MHz.

An additional exemplary embodiment includes a stamped metal monopole antenna mast for use an antenna assembly for installation to a vehicle body wall operable as an electrically large ground plane for the antenna assembly after installation thereto. The stamped metal monopole antenna mast generally includes a first conductor tuned for receiving electrical resonant frequencies within a first frequency bandwidth, and a second conductor tuned for receiving electrical resonant frequencies within a second frequency bandwidth different than the first frequency bandwidth. The first and second conductors may extend generally away from a base portion. An open slot may extend from the base portion generally between the first and second conductors. The open slot provides impedance matching for the antenna assembly.

A further exemplary embodiment includes a stamped metal monopole antenna mast for an antenna assembly for installation to a vehicle body wall operable as an electrically large ground plane for the antenna assembly after installation thereto. The stamped metal monopole antenna generally includes a first conductor tuned to at least one electrical resonant frequency for operating within a bandwidth ranging from about 800 MHz to about 1000 MHz, and a second conductor tuned to at least one electrical resonant frequency for operating within a bandwidth of about 1650 MHz to about 2700 MHz. An open slot may extend at least partially between the first and second conductors to provide impedance matching. The antenna mast may be configured to have an average vertical gain of about negative five dBi or higher at an elevation angle of about zero degrees at frequencies within the bandwidth ranging from about 800 MHz to about 1000 MHz and at frequencies within the bandwidth ranging from about 1650 MHz to about 2700 MHz.

Yet another exemplary embodiment includes an antenna assembly for installation to a vehicle body wall operable as an electrically large ground plane for the antenna assembly after installation thereto. The antenna assembly generally includes a monopole antenna mast stamped from a piece of sheet metal. The antenna mast may be tuned for operating at frequencies within a bandwidth ranging from about 800 MHz to about 1000 MHz and at frequencies within a bandwidth ranging from about 1650 MHz to about 2700 MHz.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 15:
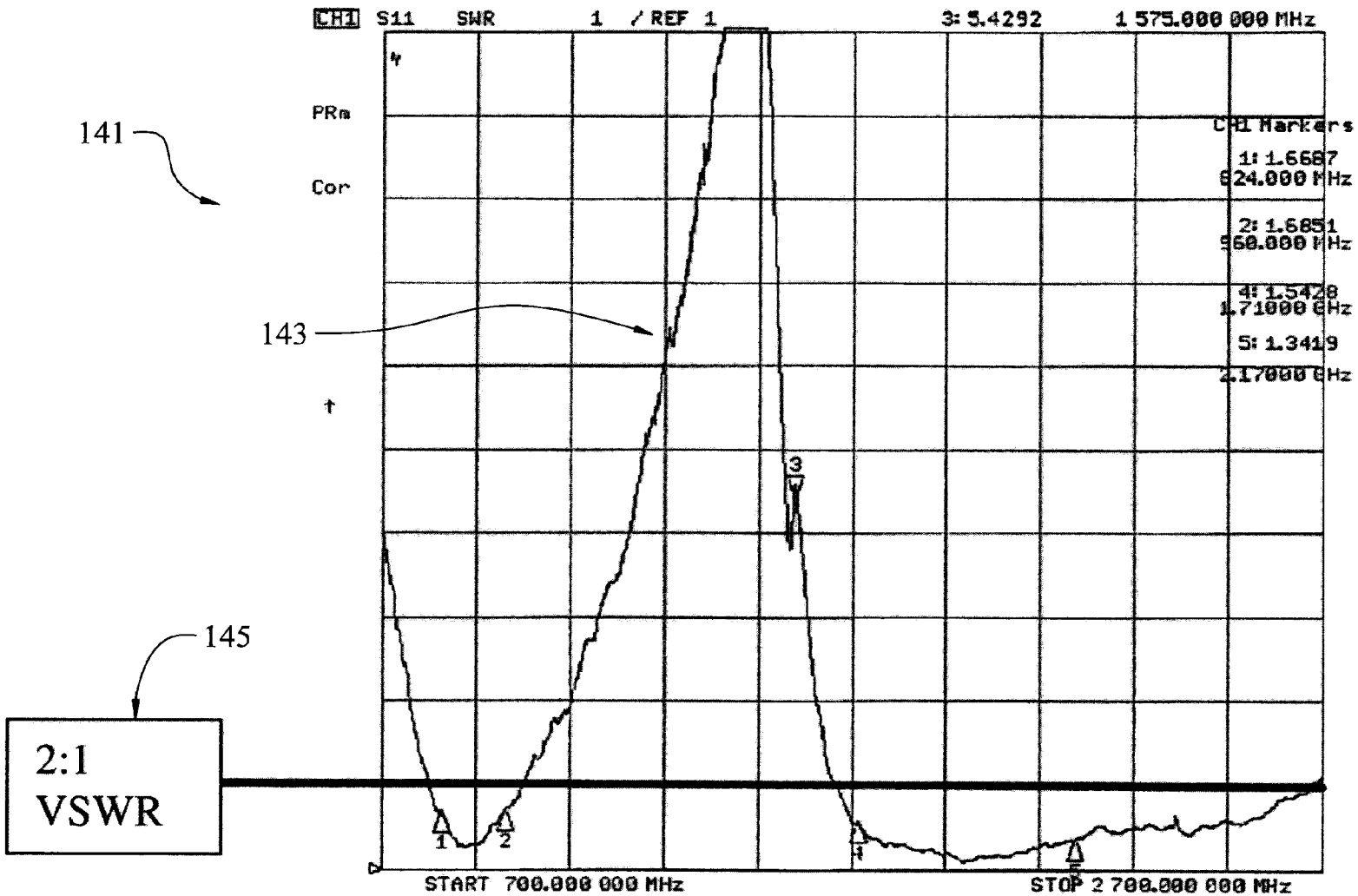
Figure 16:
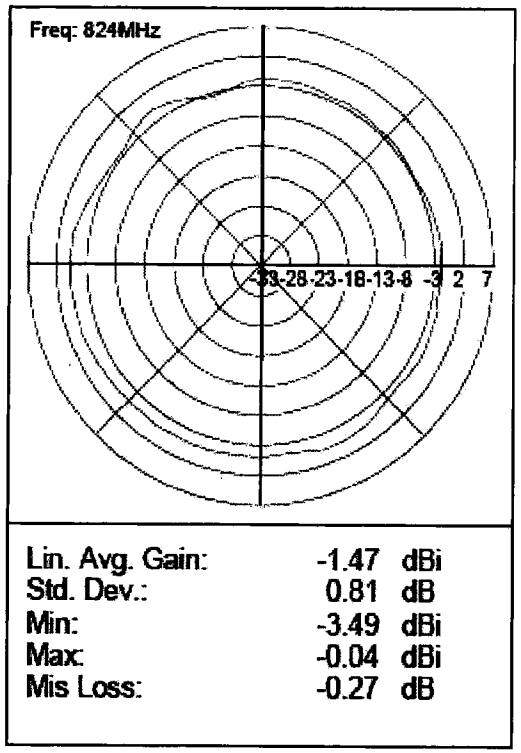
Figure 17:
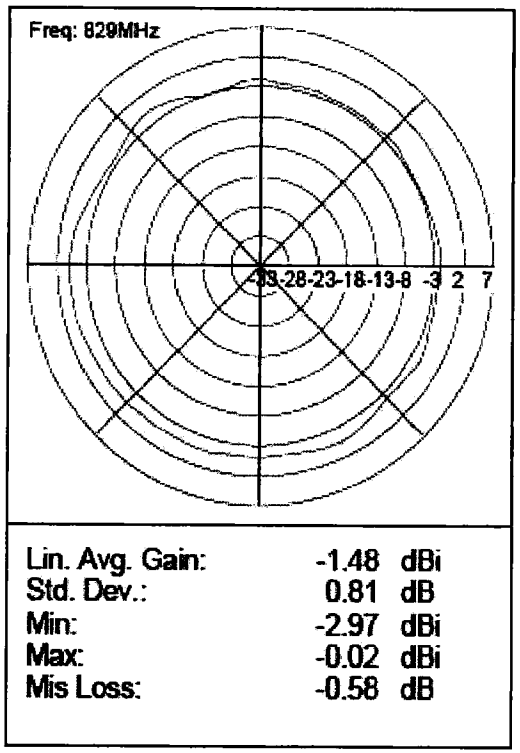
Figure 18:
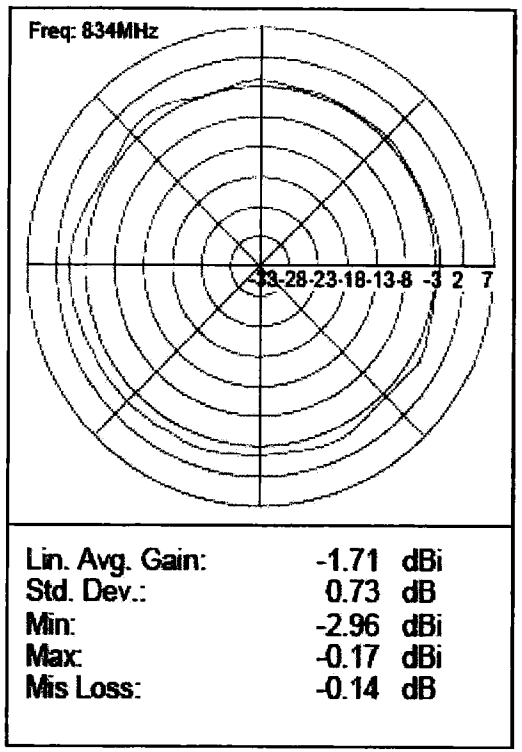
Figure 19:
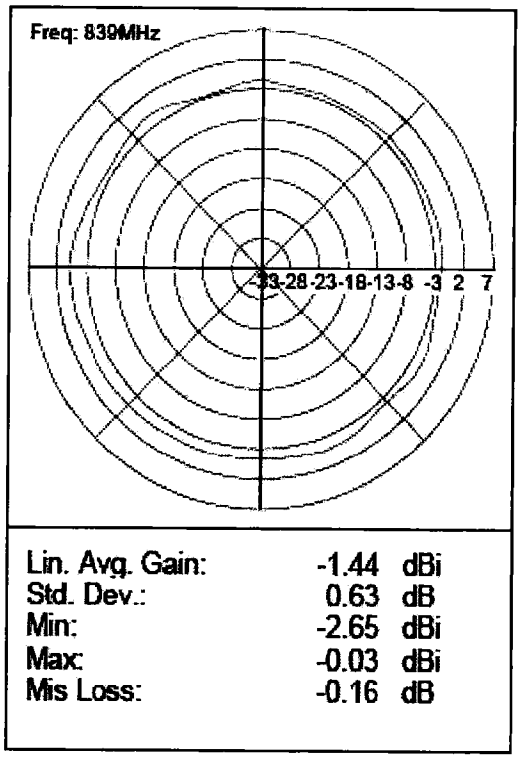
Figure 20:
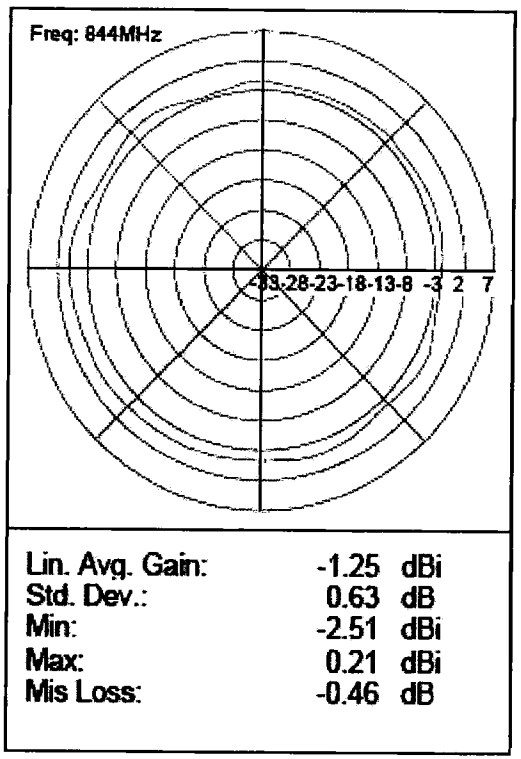
Figure 21:
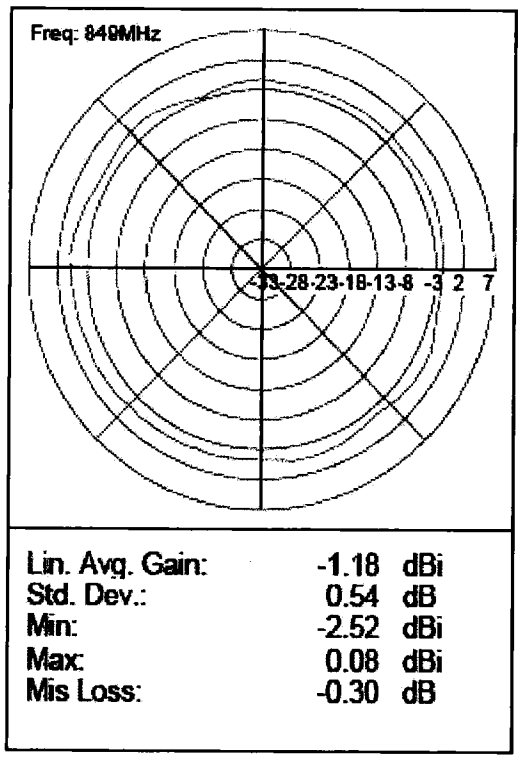
Figure 22:
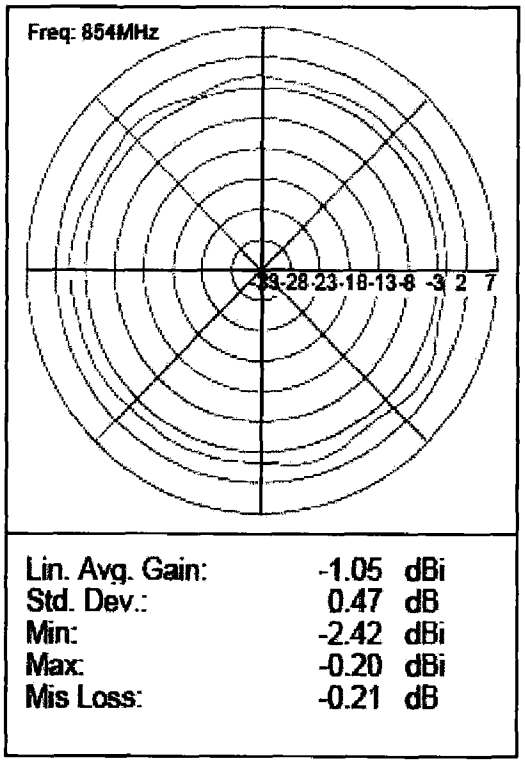
Figure 23:
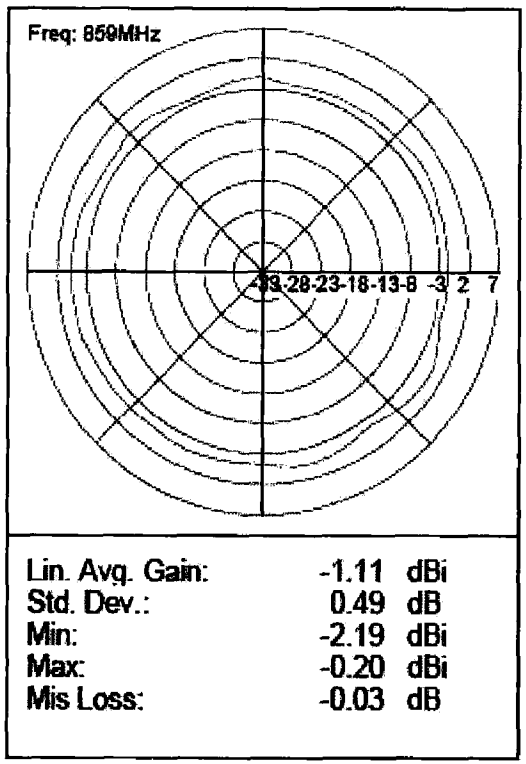
Figure 24:
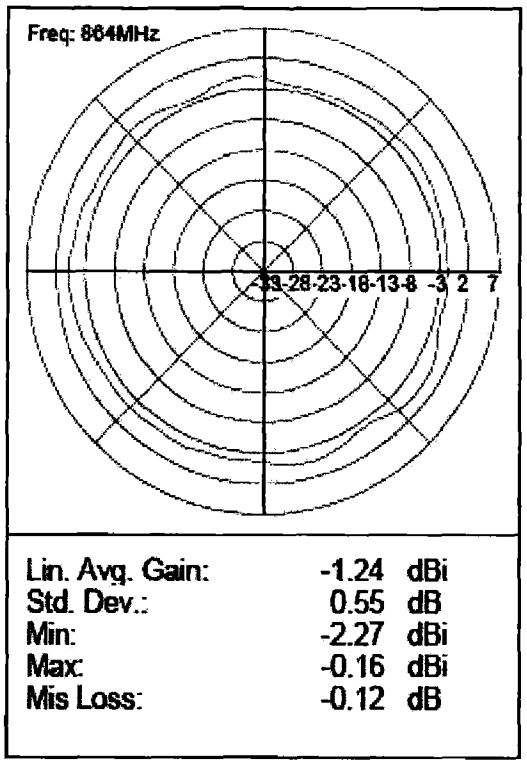
Figure 25:
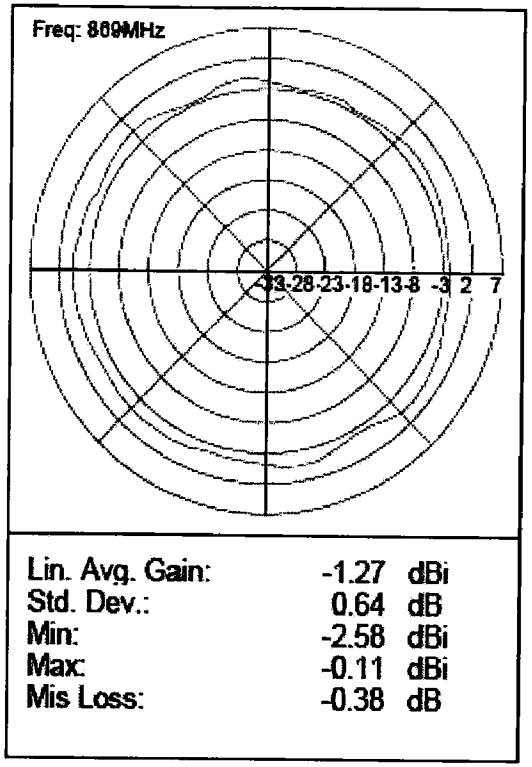
Figure 26:
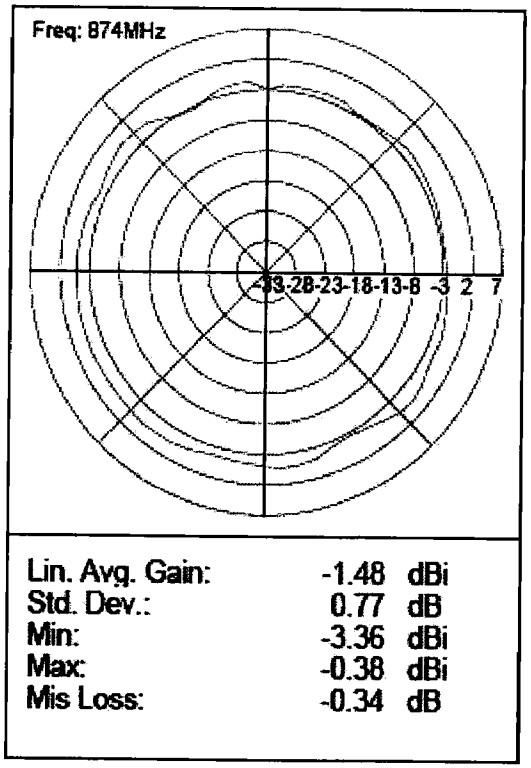
Figure 27:
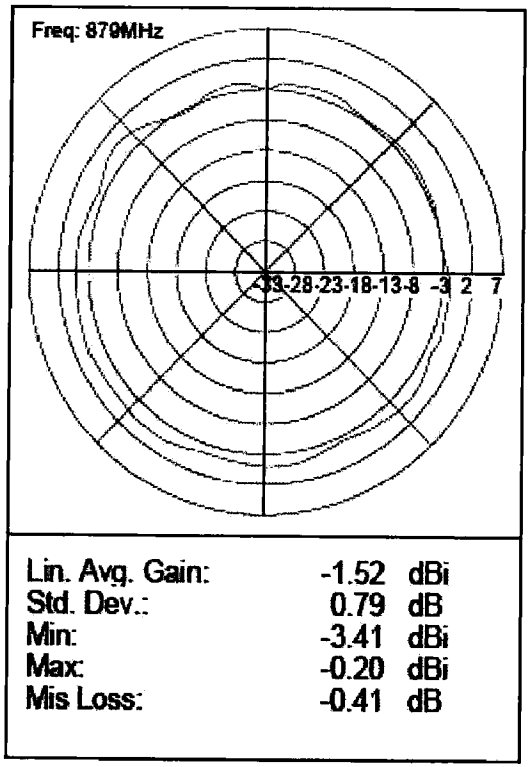
Figure 28:
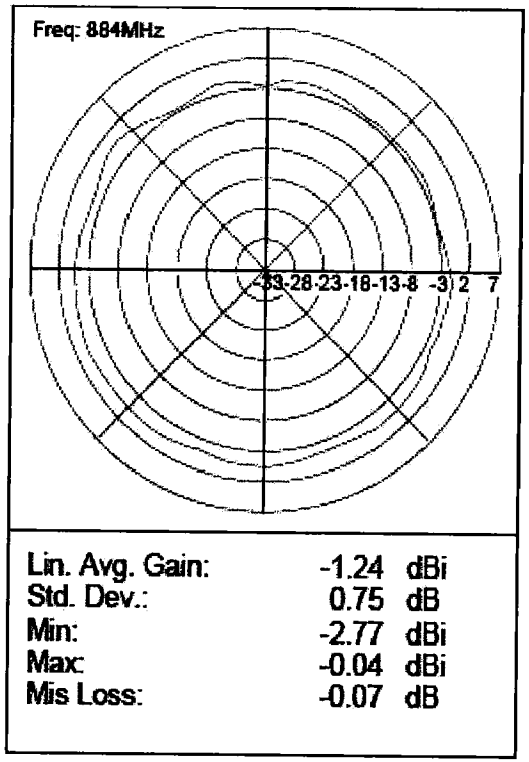
Figure 29:
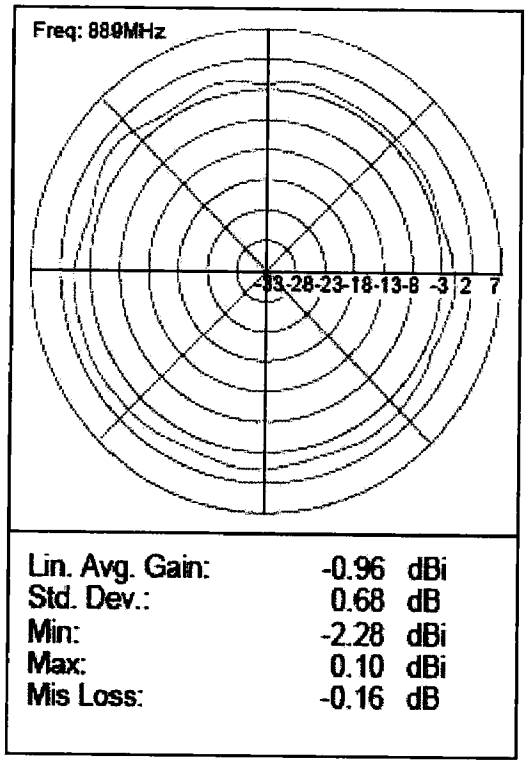
Figure 30:
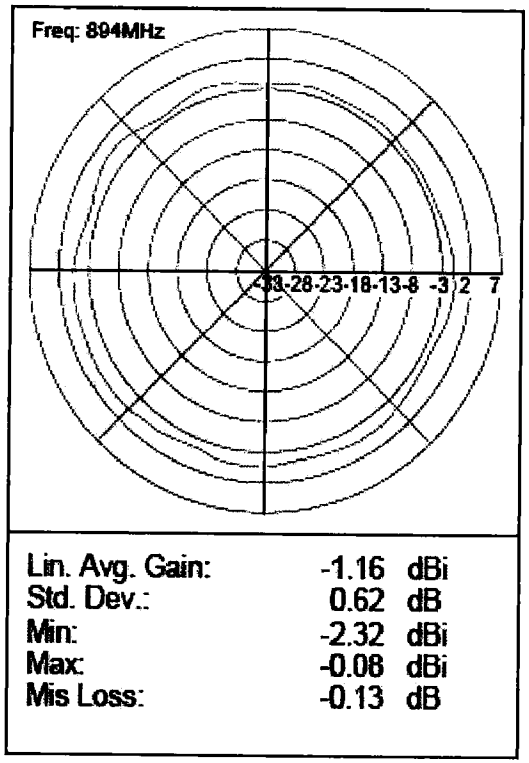
Figure 31:
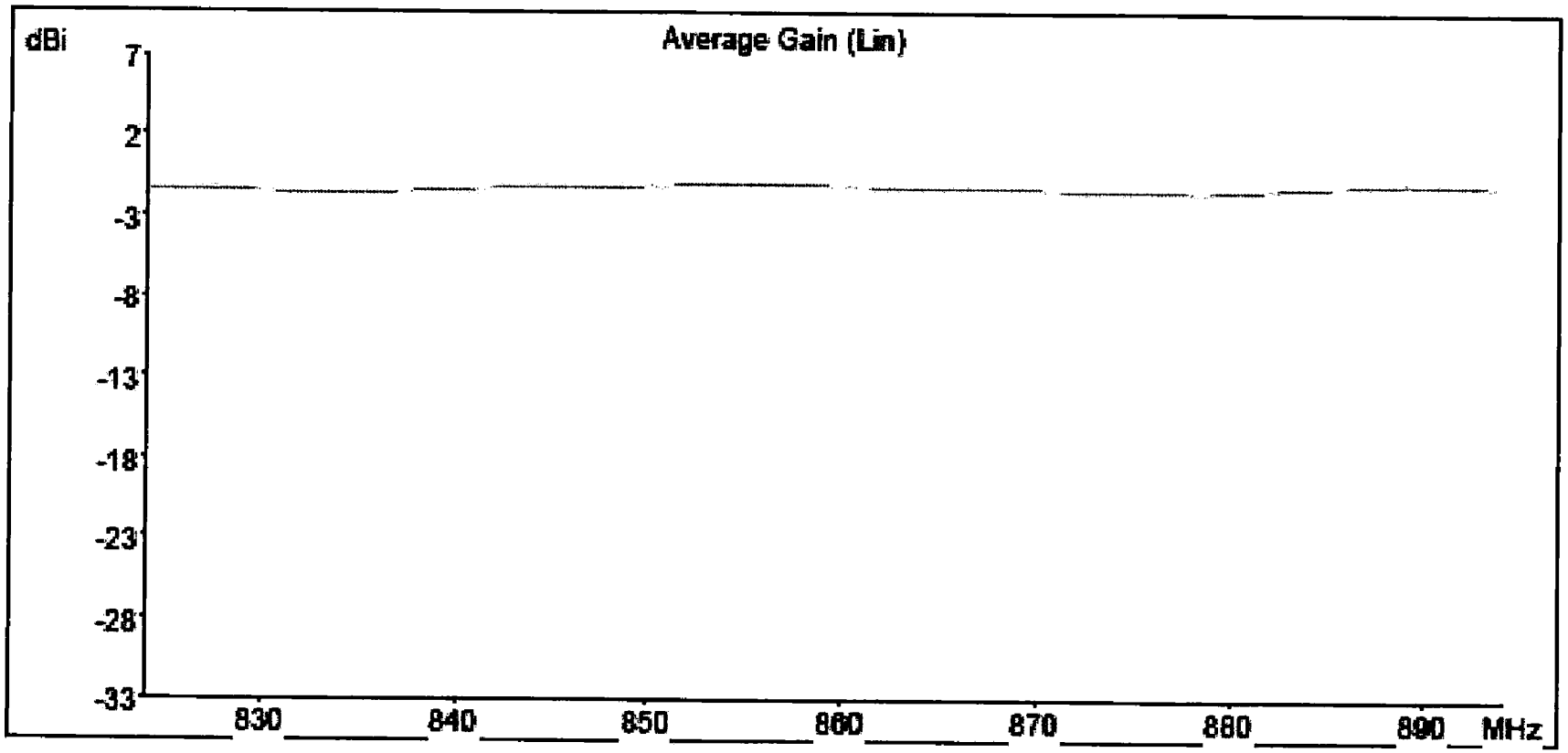
Figure 47:
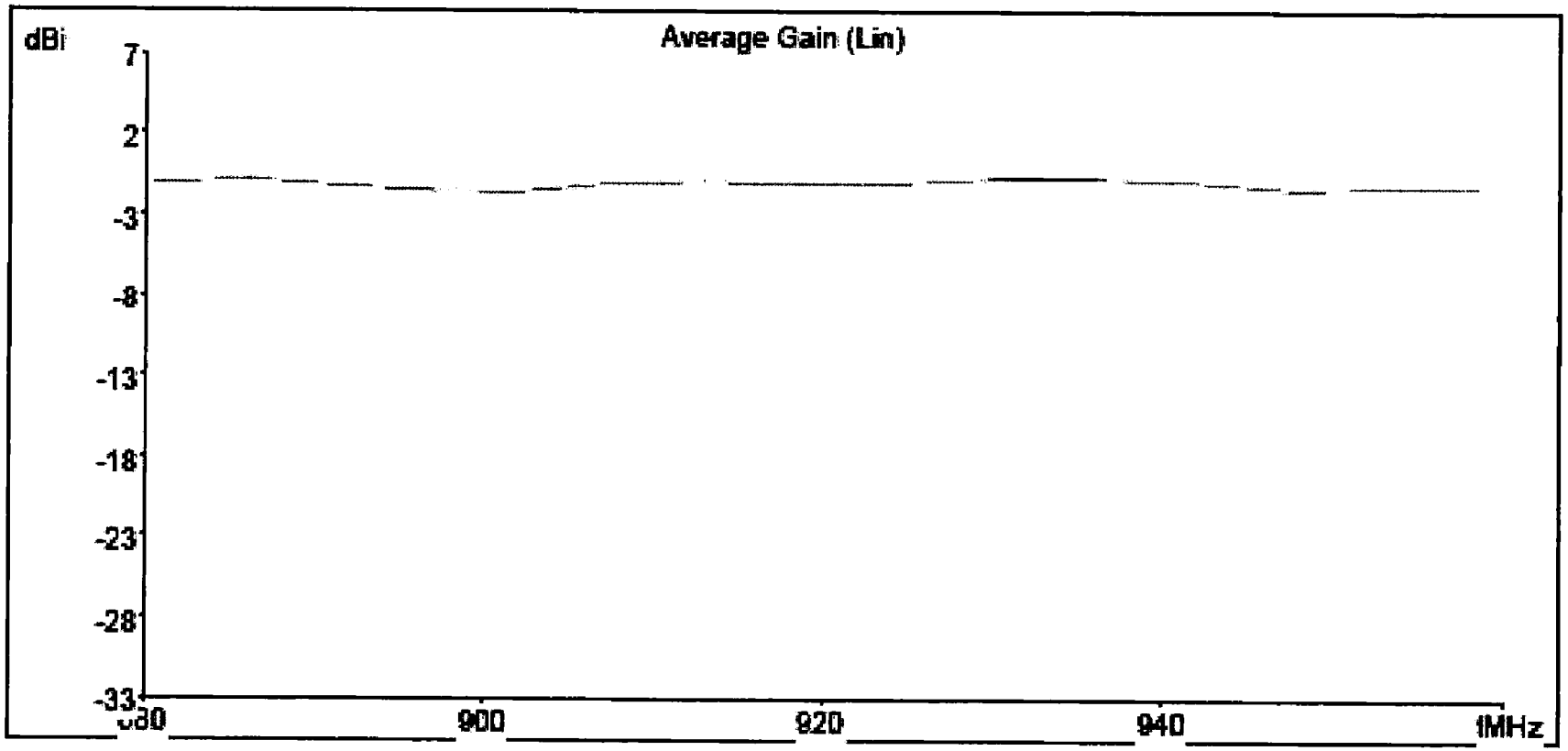
Figure 48:
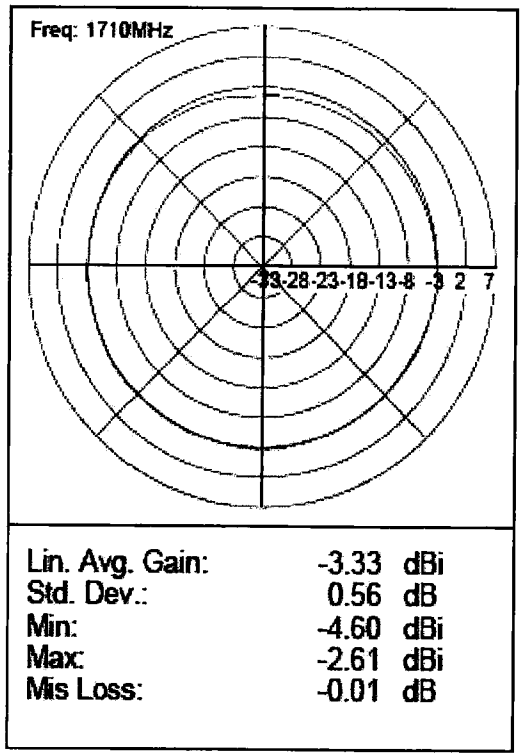
Figure 49:
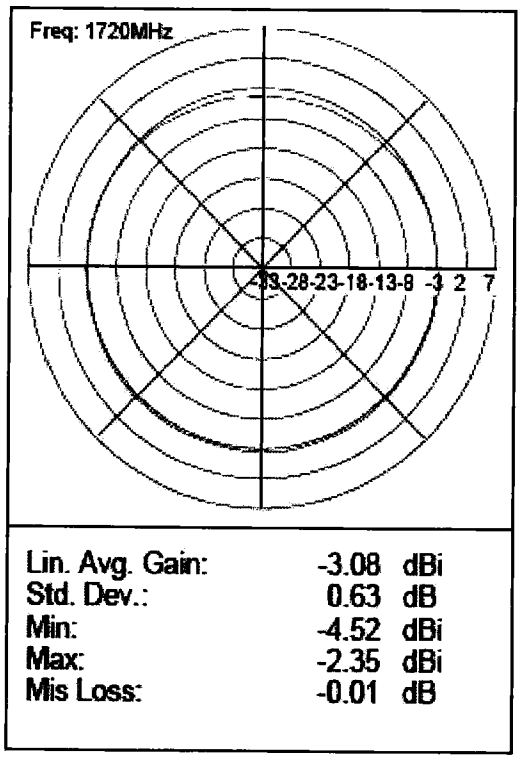
Figure 50:
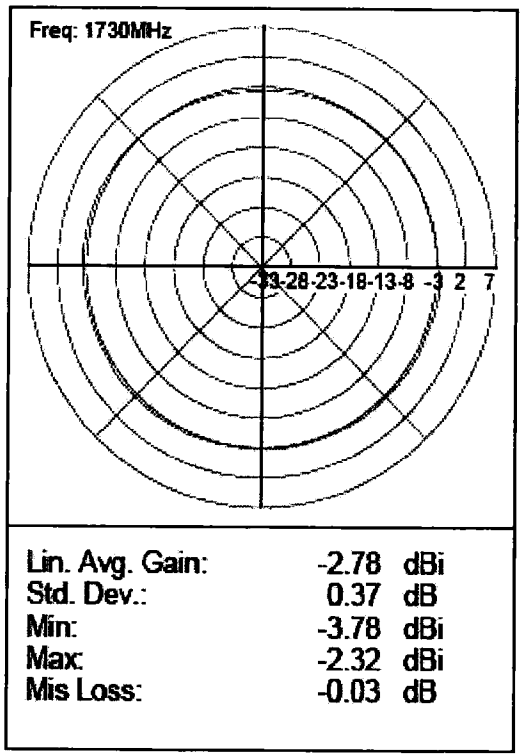
Figure 51:
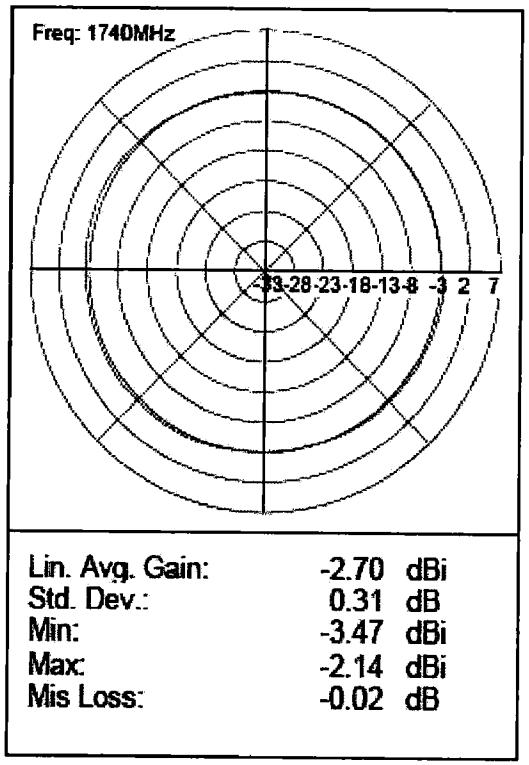
Figure 52:
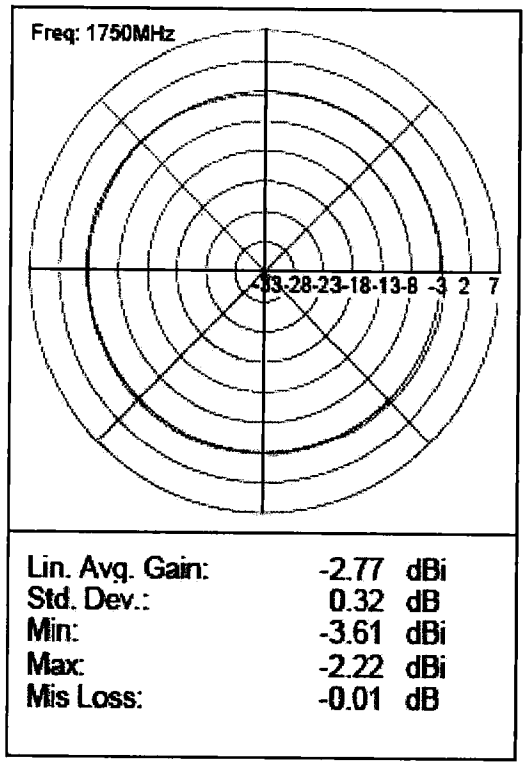
Figure 53:
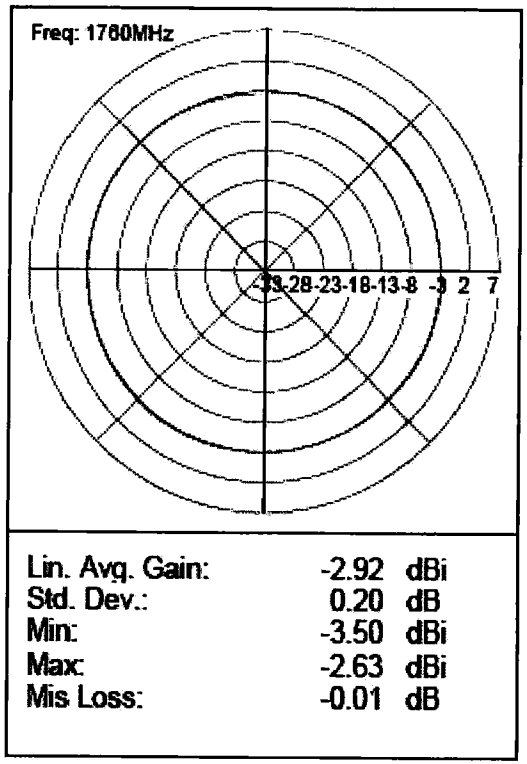
Figure 54:
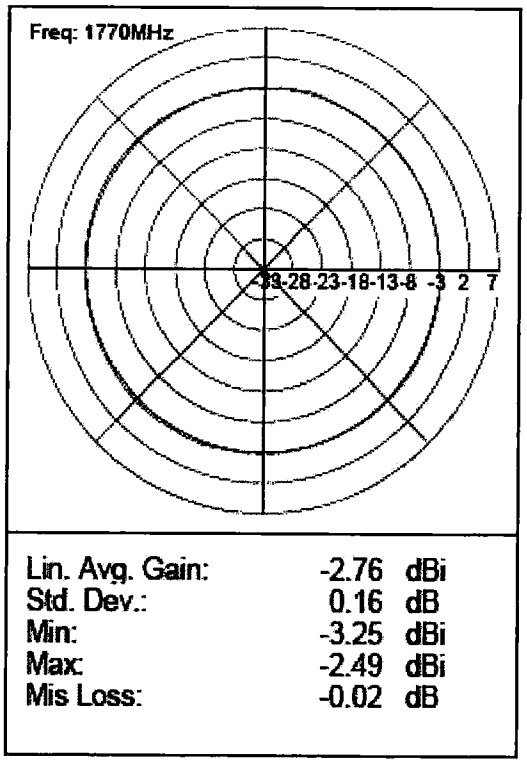
Figure 55:
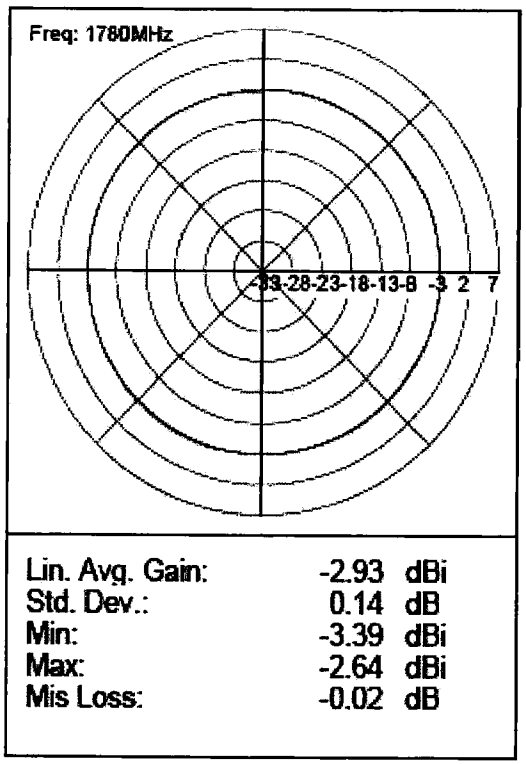
Figure 56:
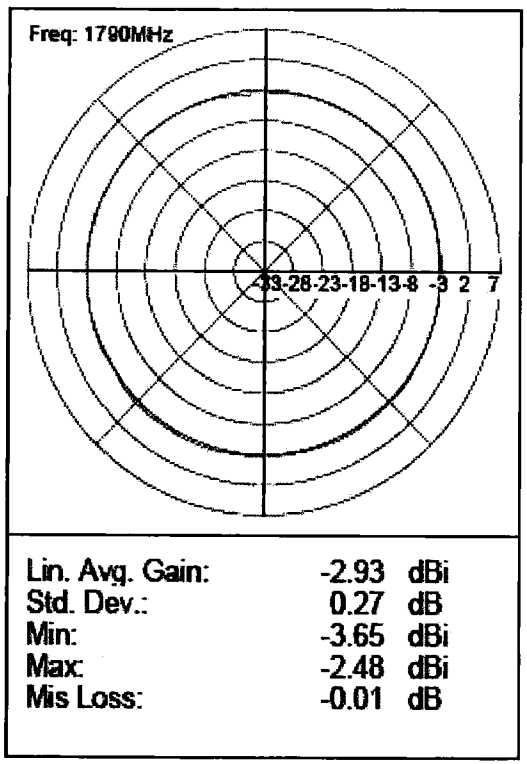
Figure 57:
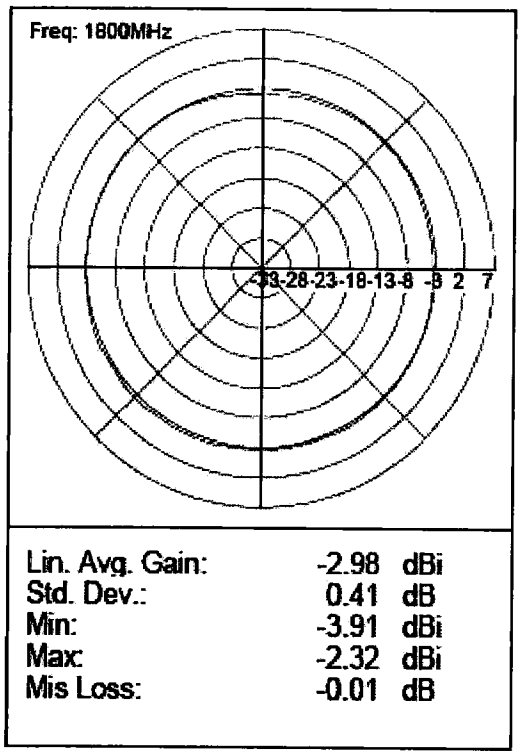
Figure 58:
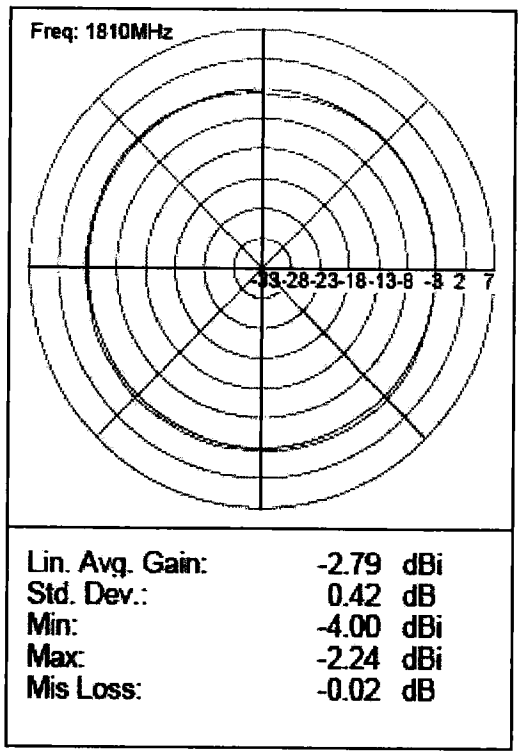
Figure 59:
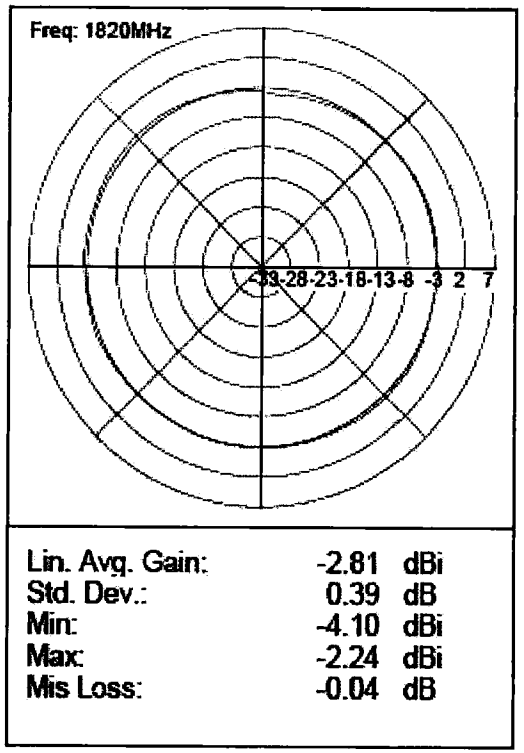
Figure 60:
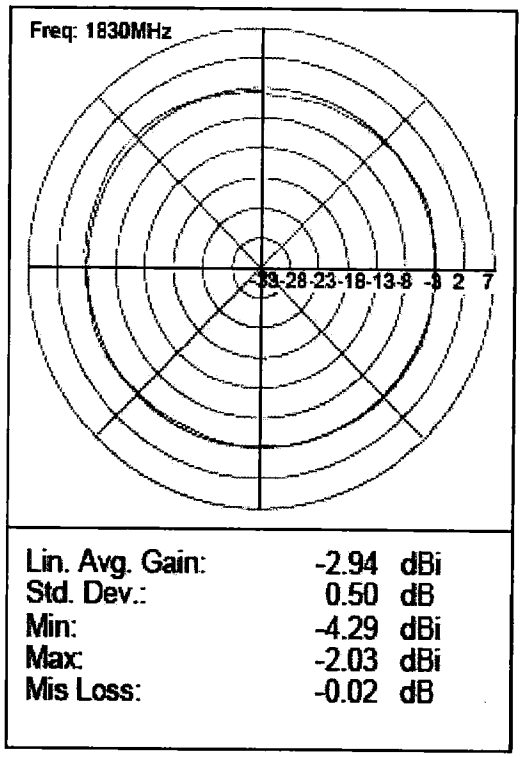
Figure 61:
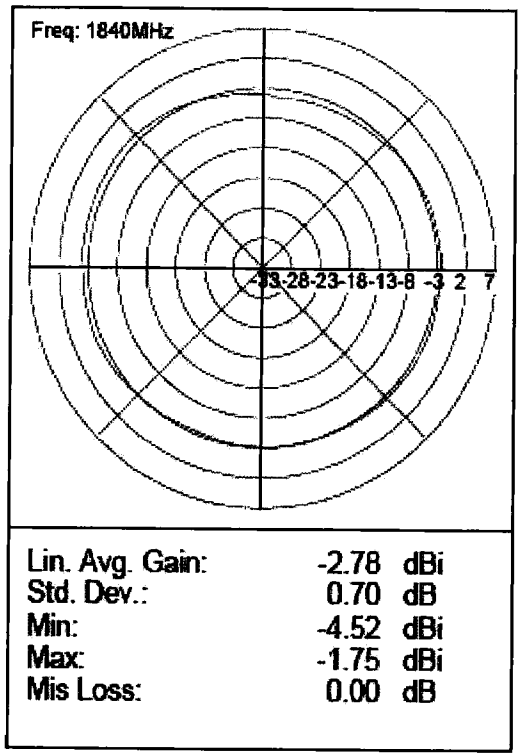
Figure 62:
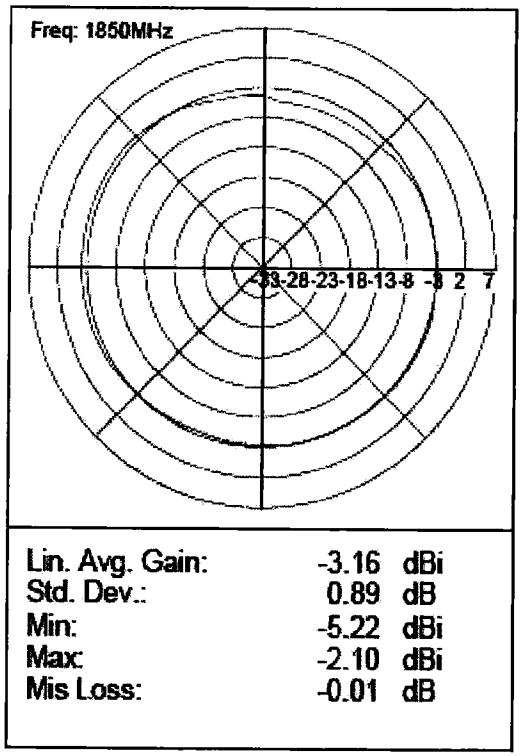
Figure 63:
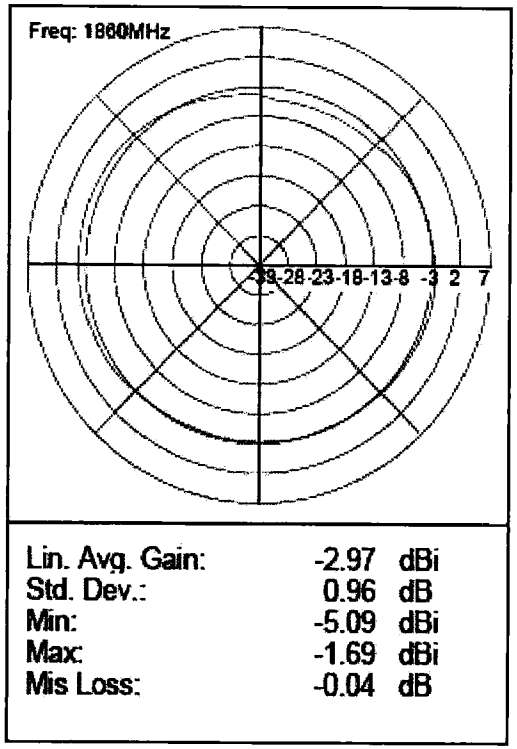
Figure 64:
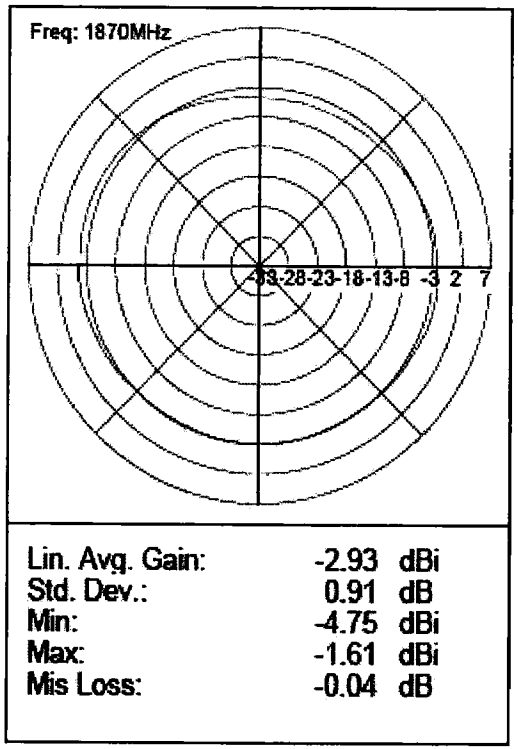
Figure 65:
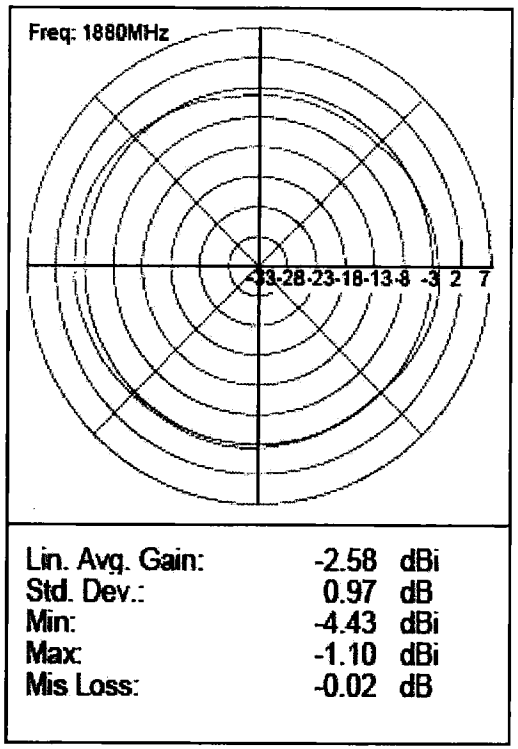
Figure 66:
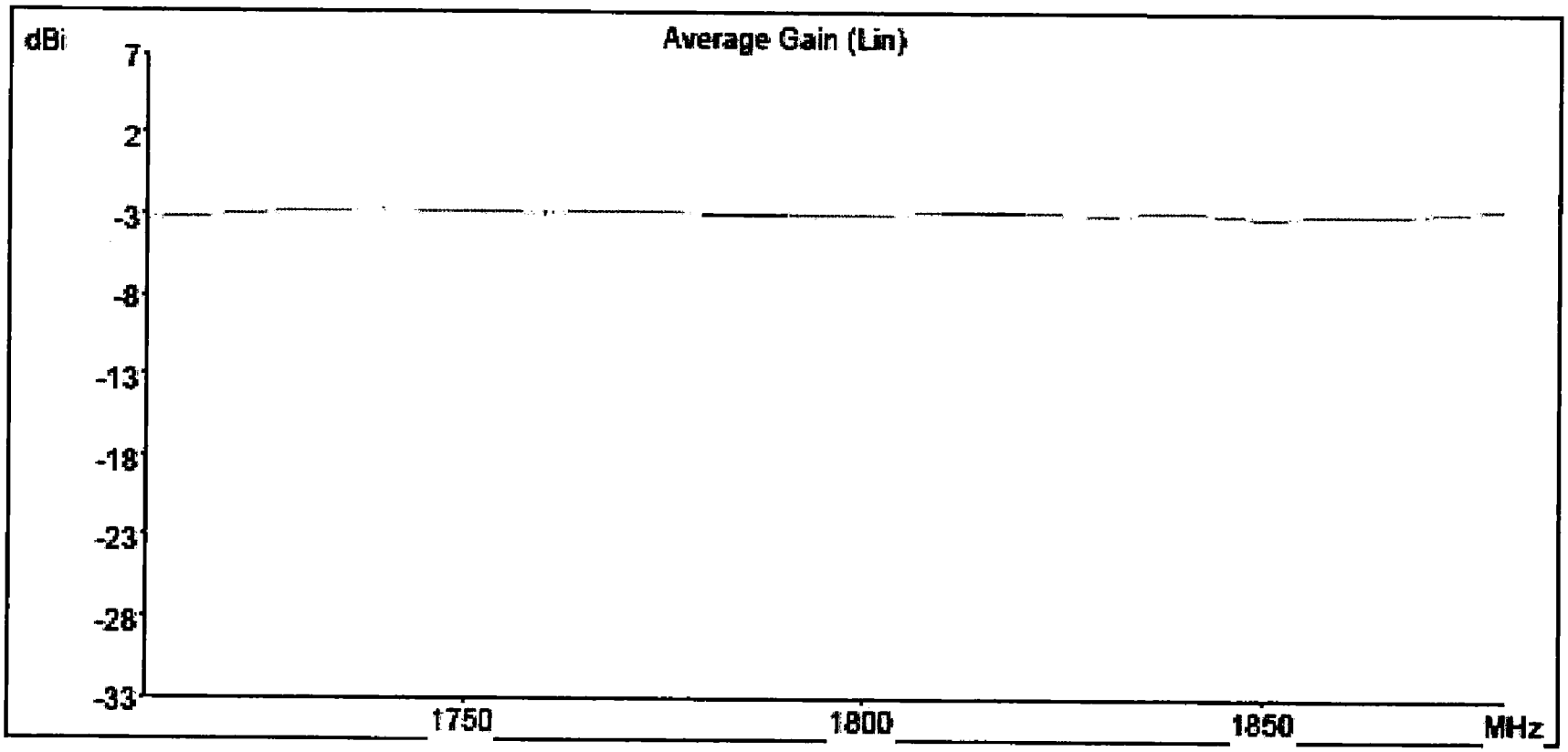
Figure 67:
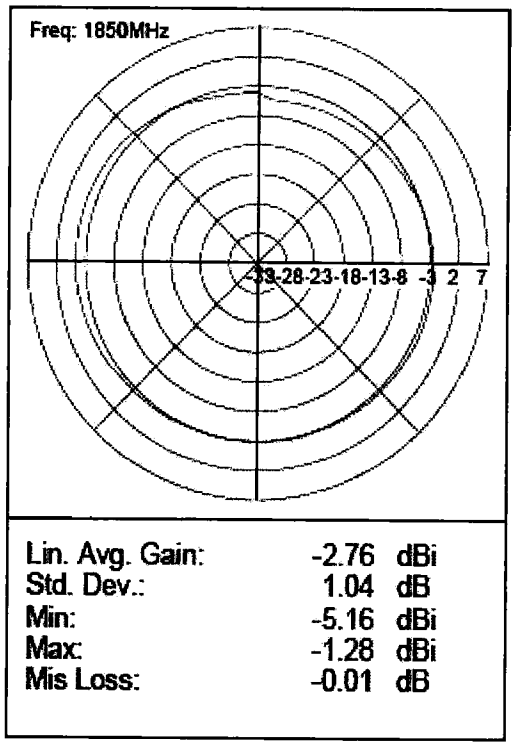
Figure 68:
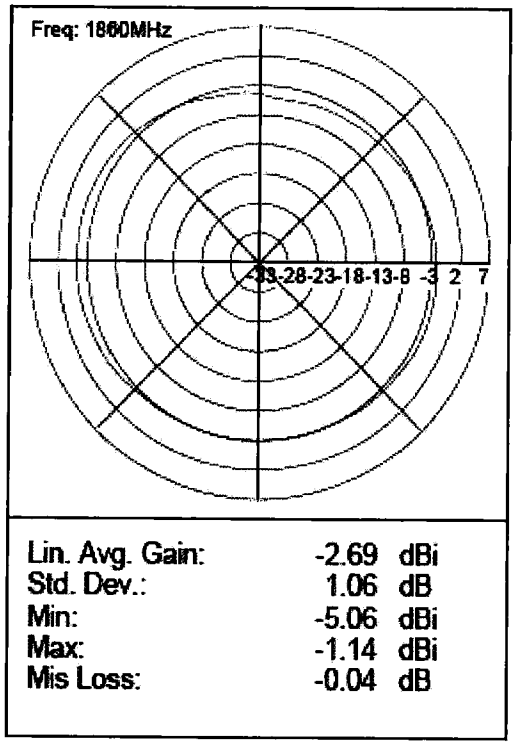
Figure 69:
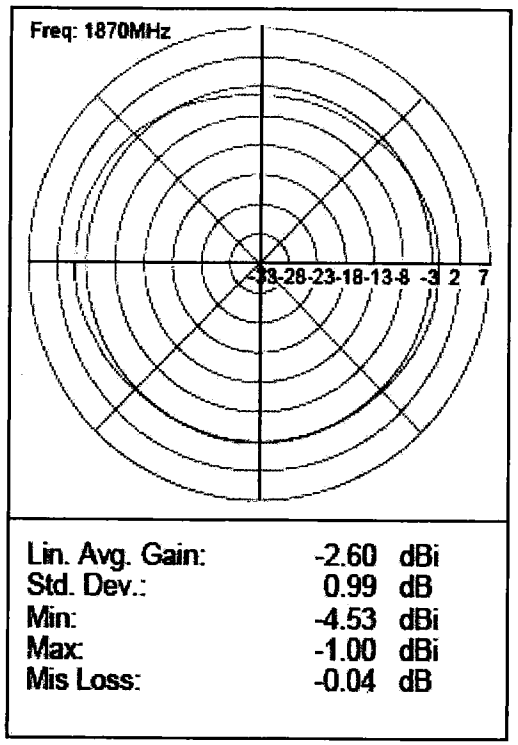
Figure 70:
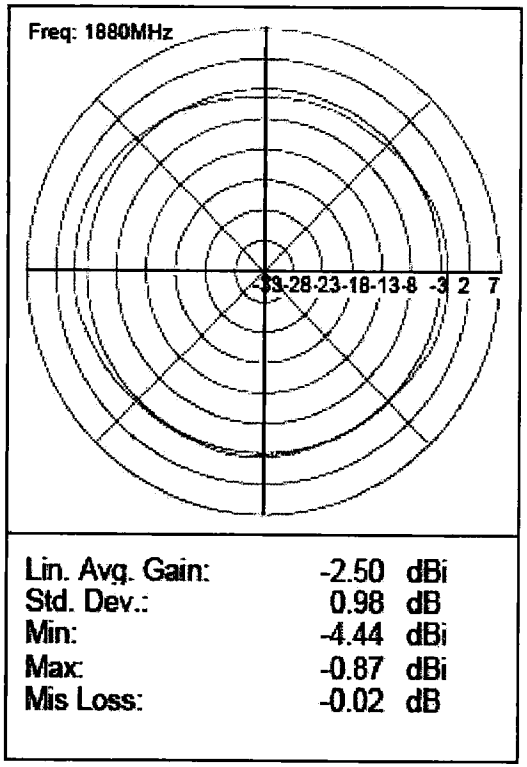
Figure 71:
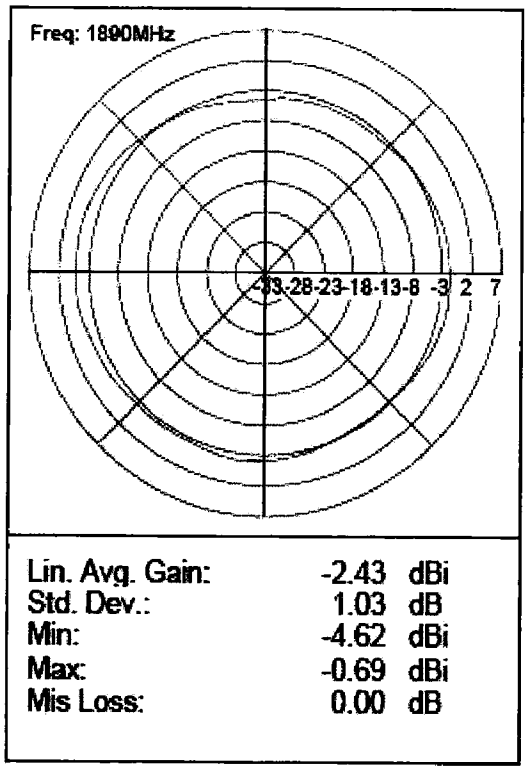
Figure 72:
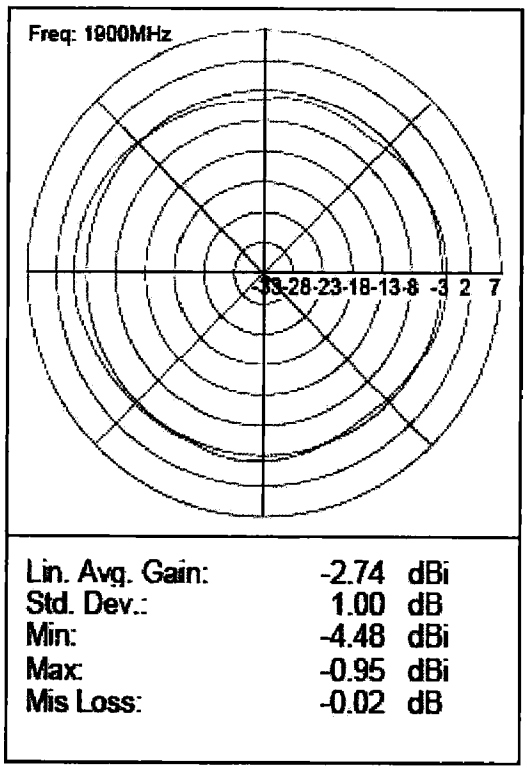
Figure 73:
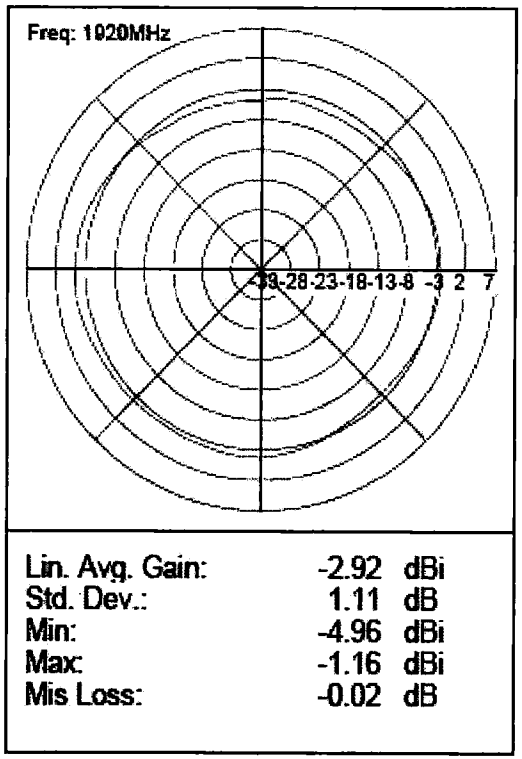
Figure 74:
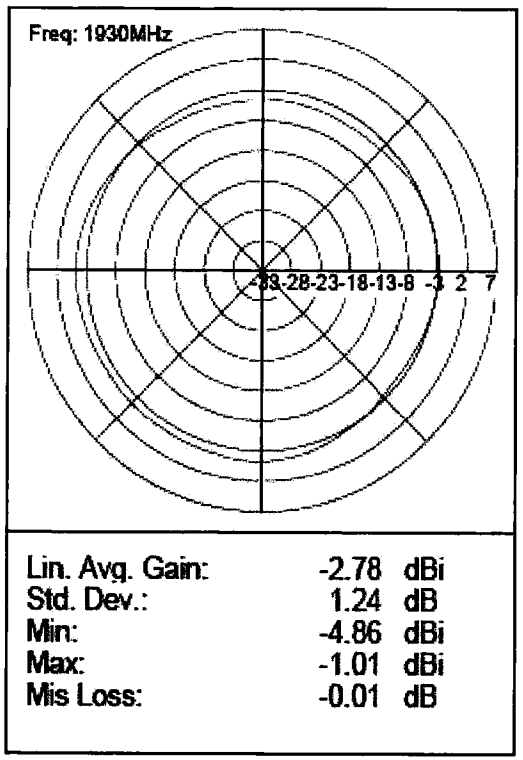
Figure 75:
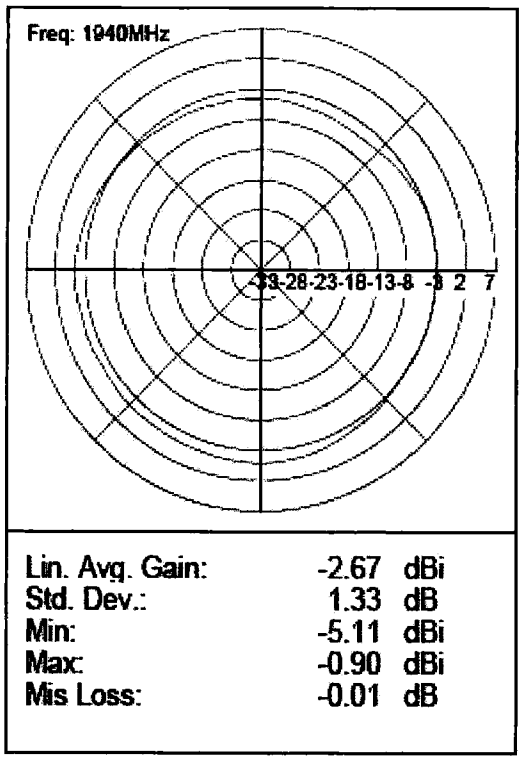
Figure 76:
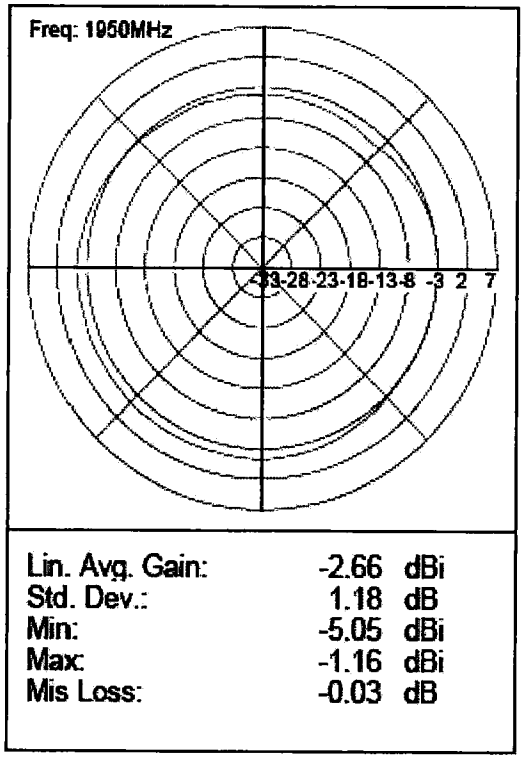
Figure 77:
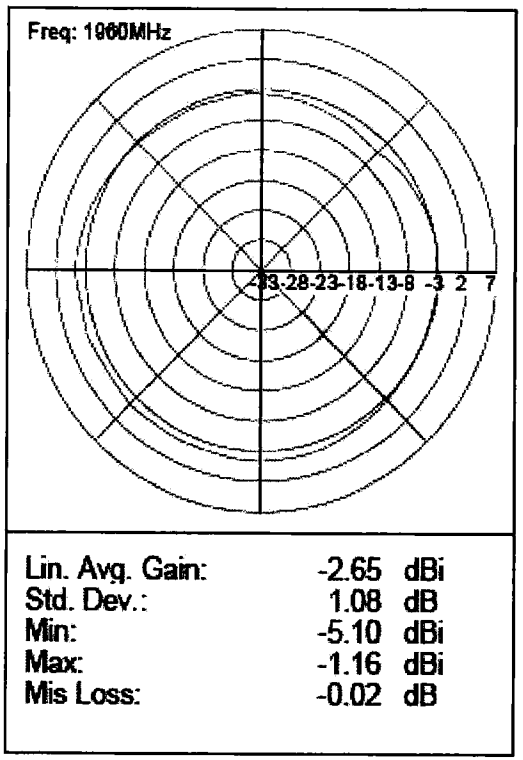
Figure 78:
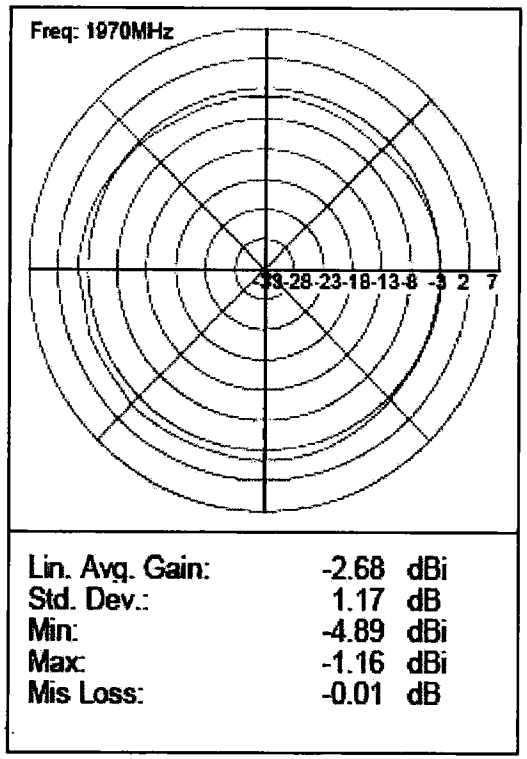
Figure 79:
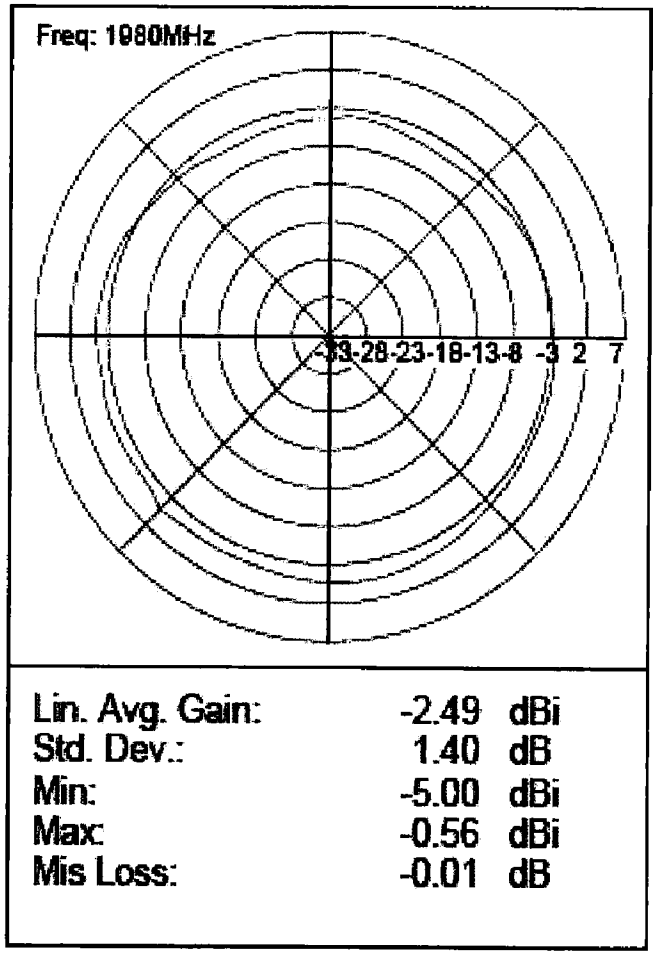
Figure 80:
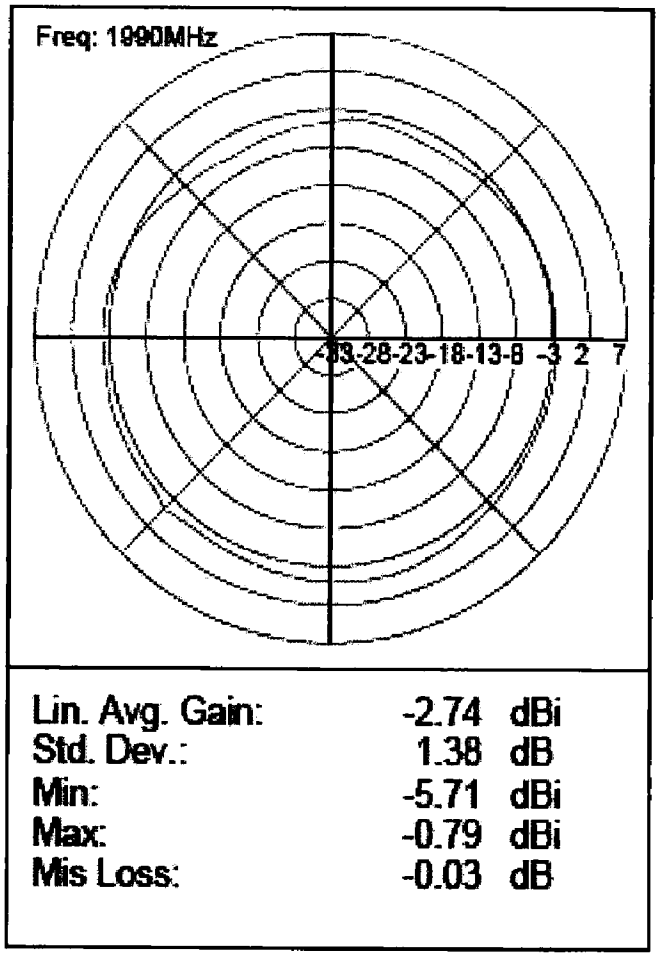
Figure 81:
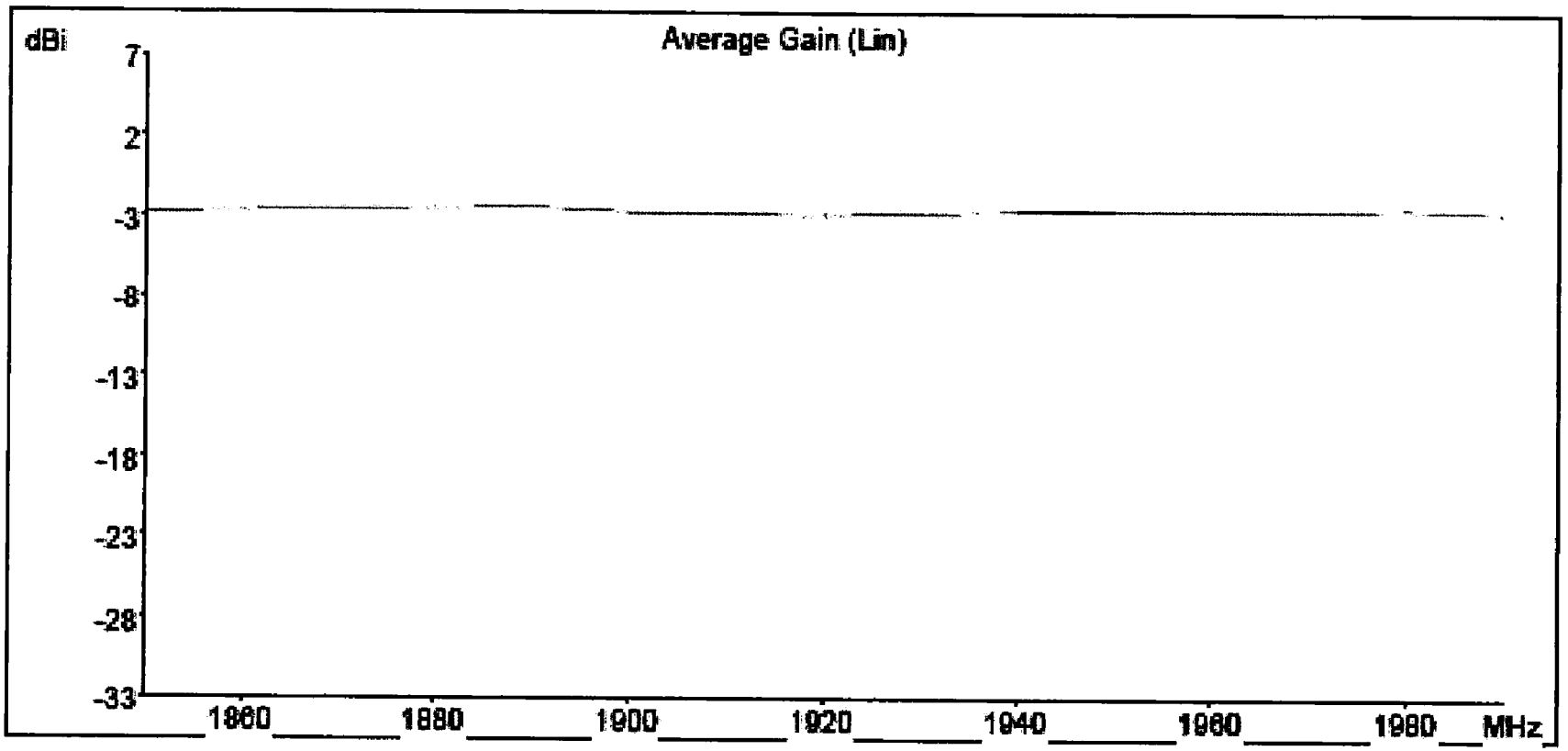
Figure 82:
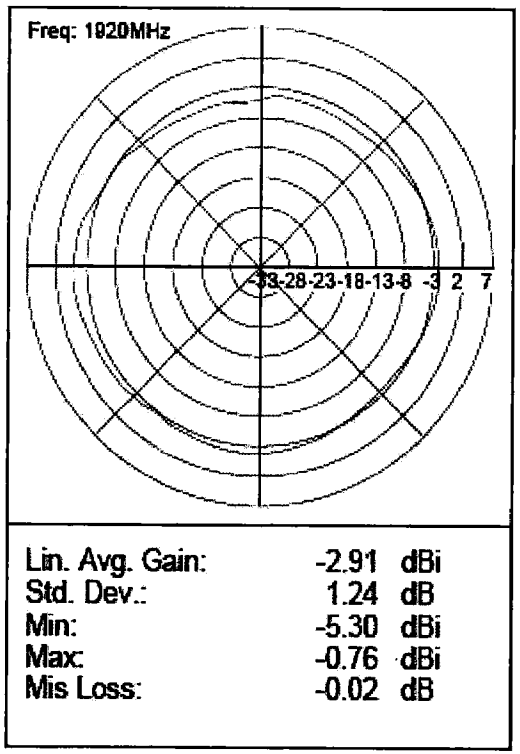
Figure 83:
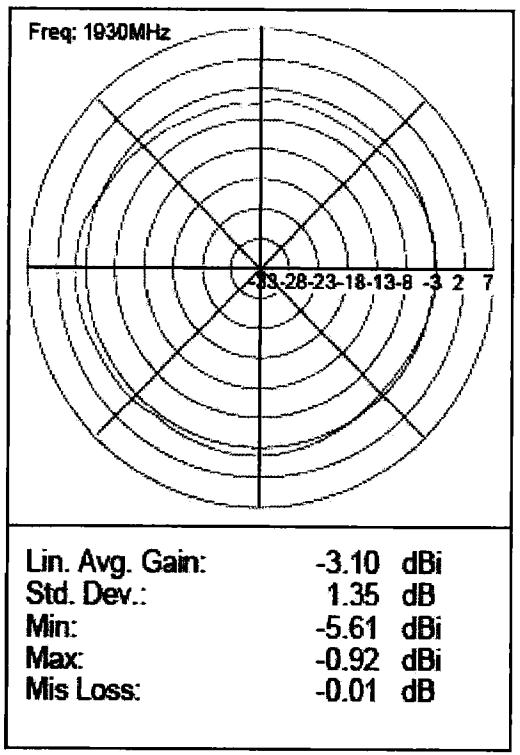
Figure 84:
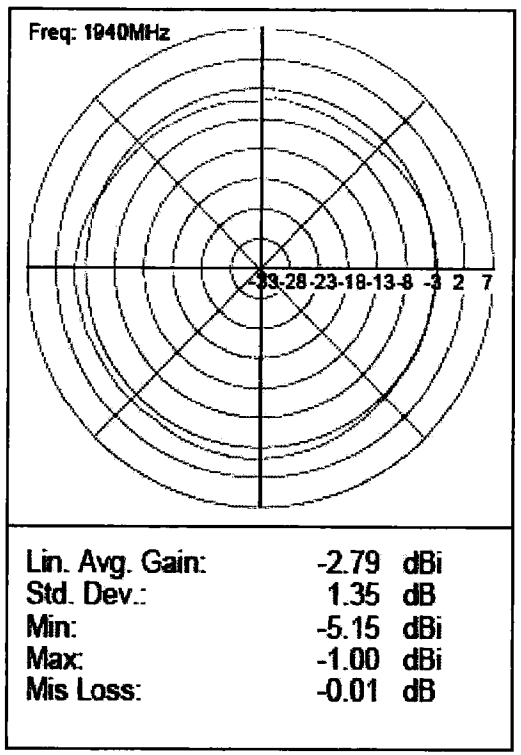
Figure 85:
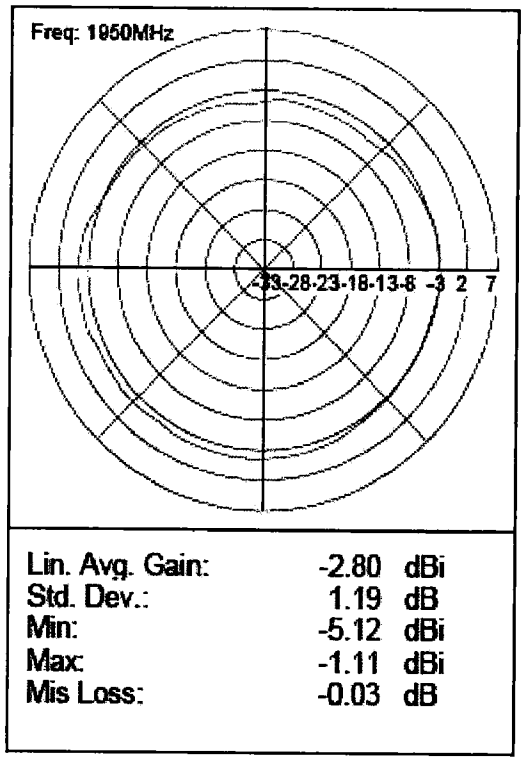
Figure 86:
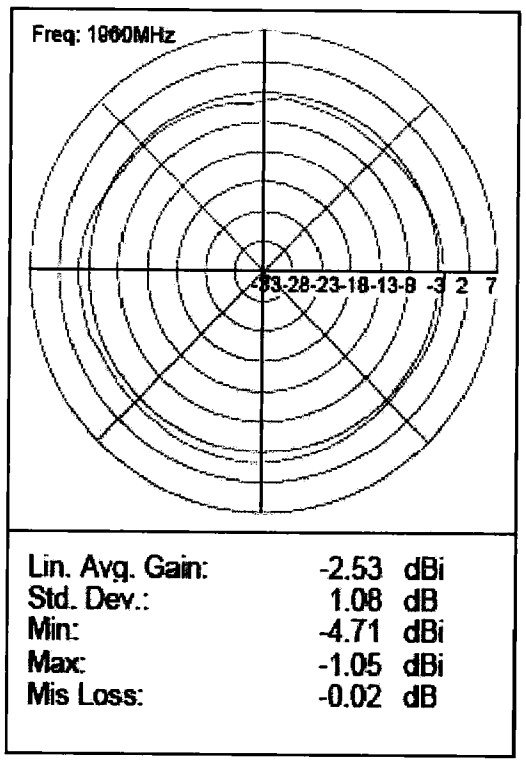
Figure 87:
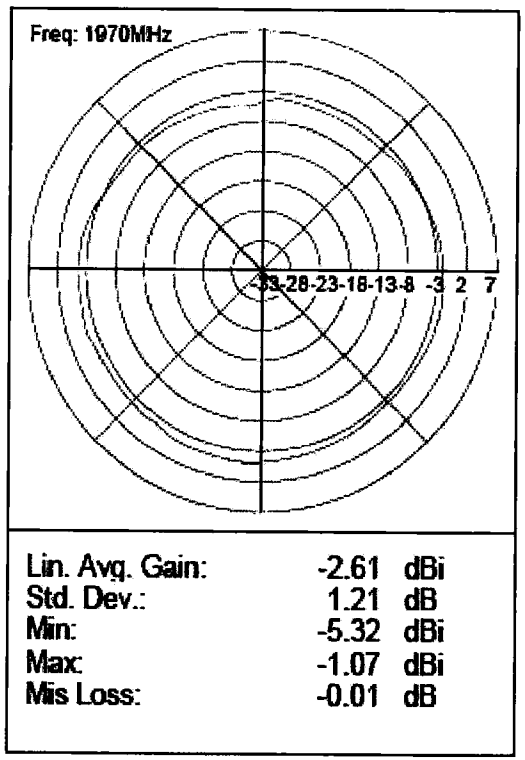
Figure 88:
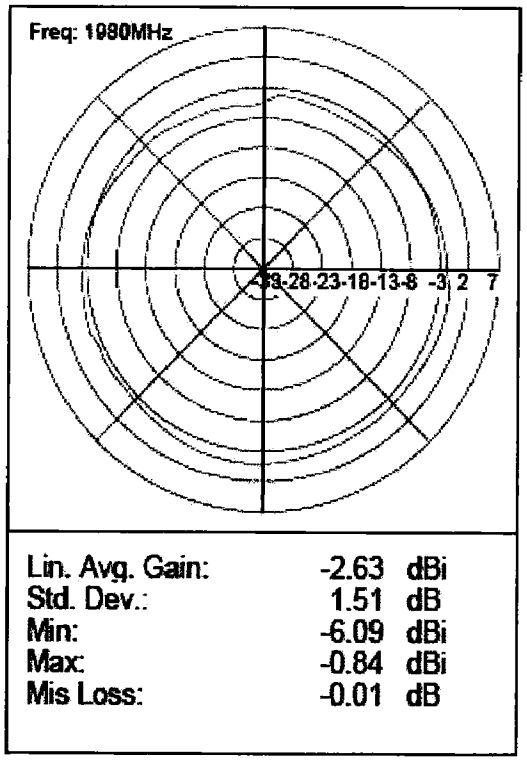
Figure 89:
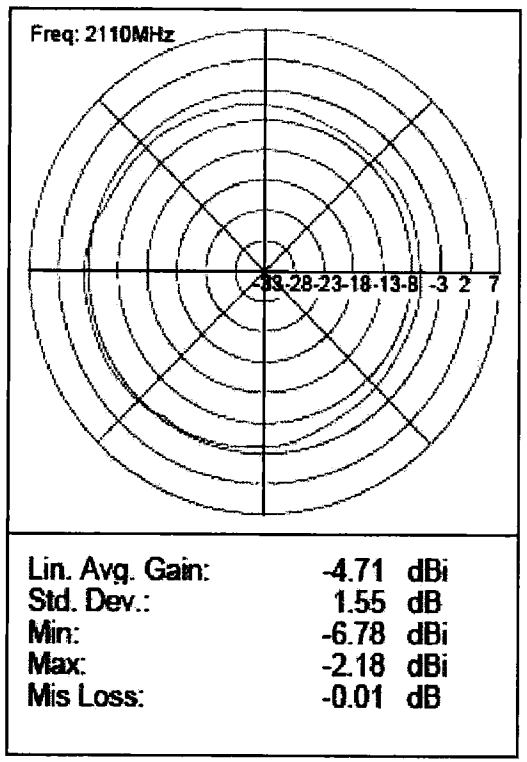
Figure 90:
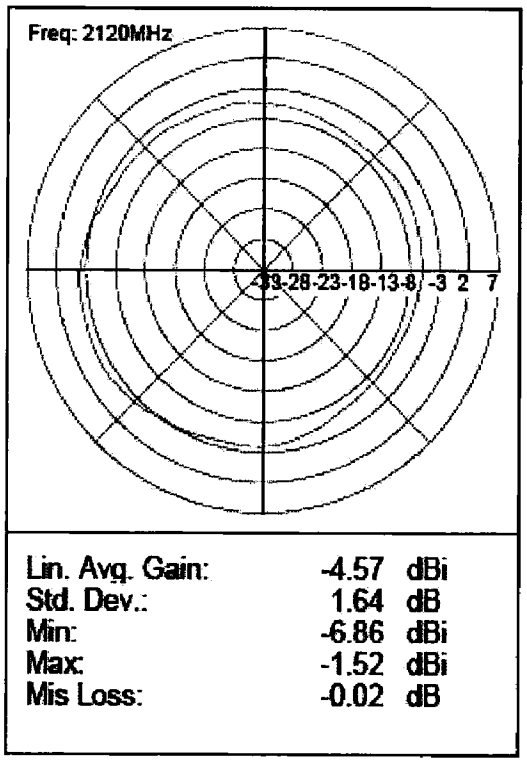
Figure 91:
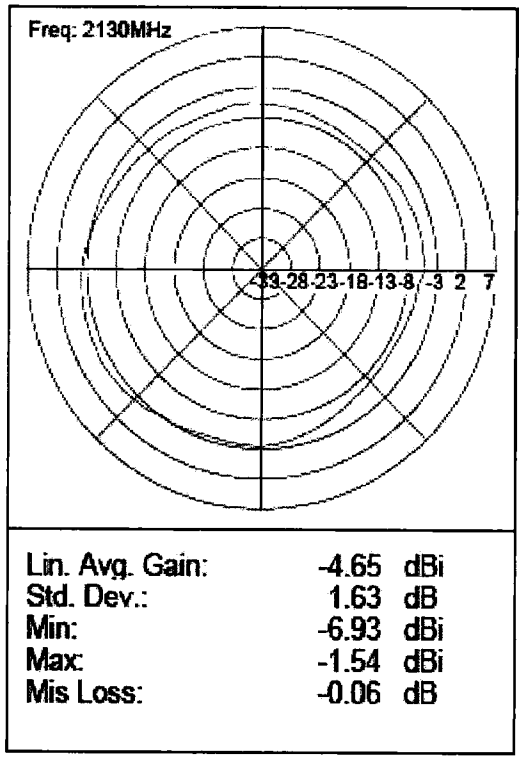
Figure 92:
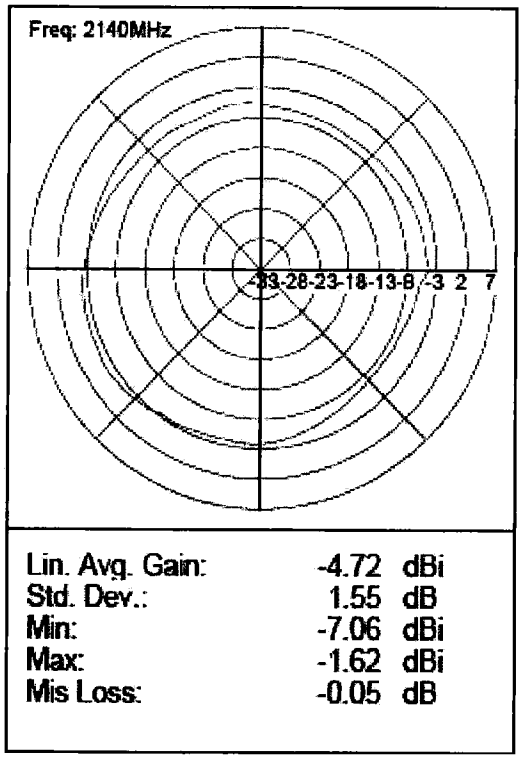
Figure 93:
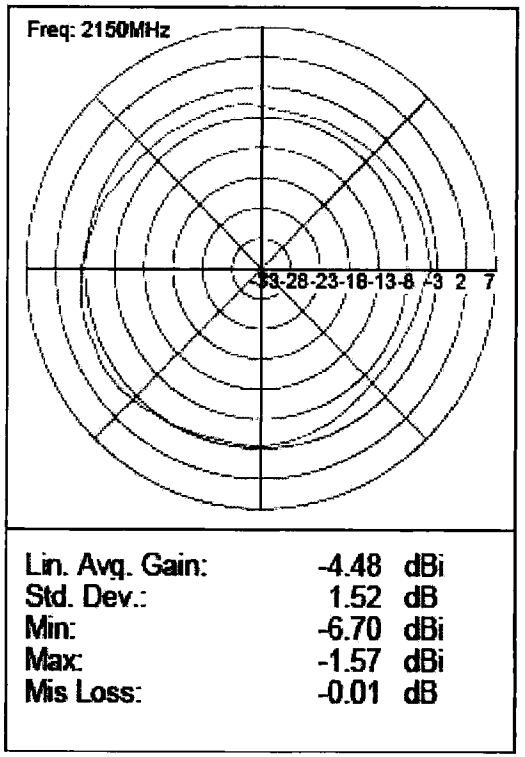
Figure 95:
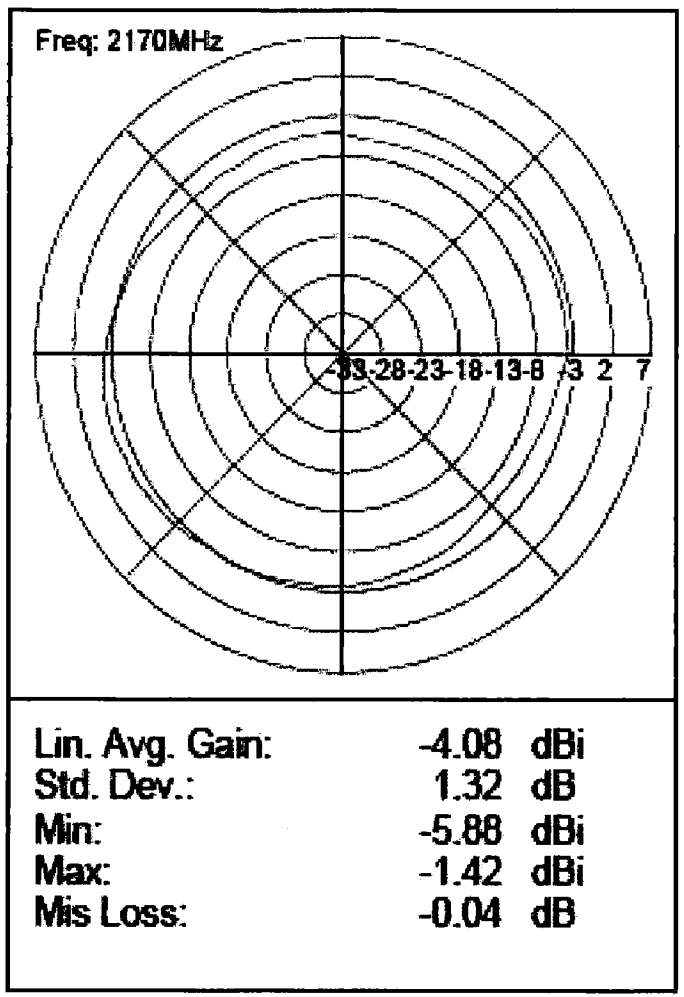
Figure 94:
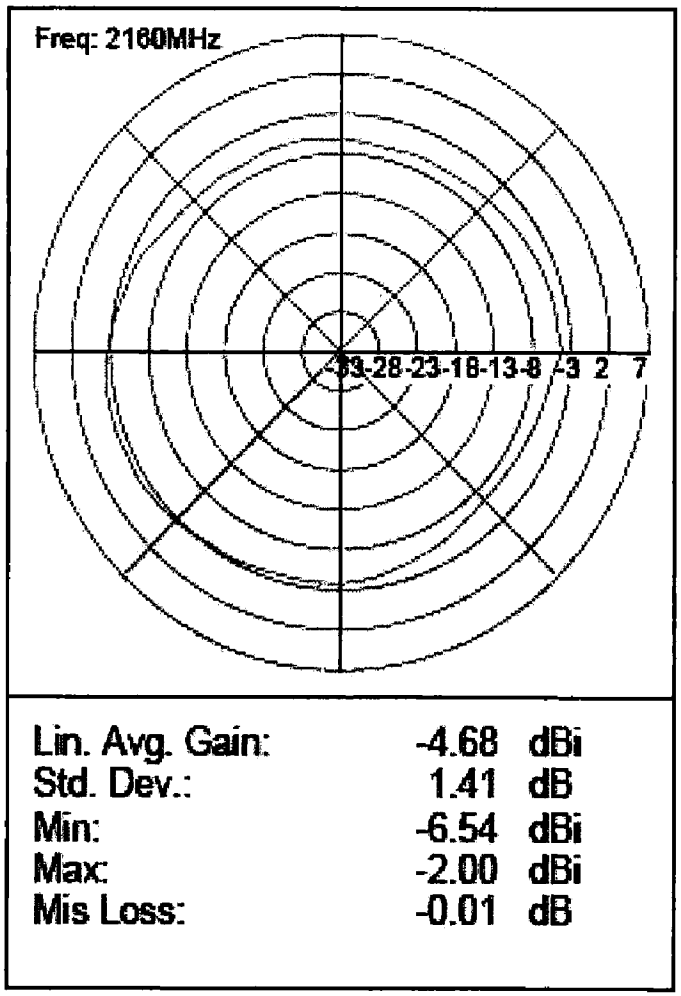
Figure 96:
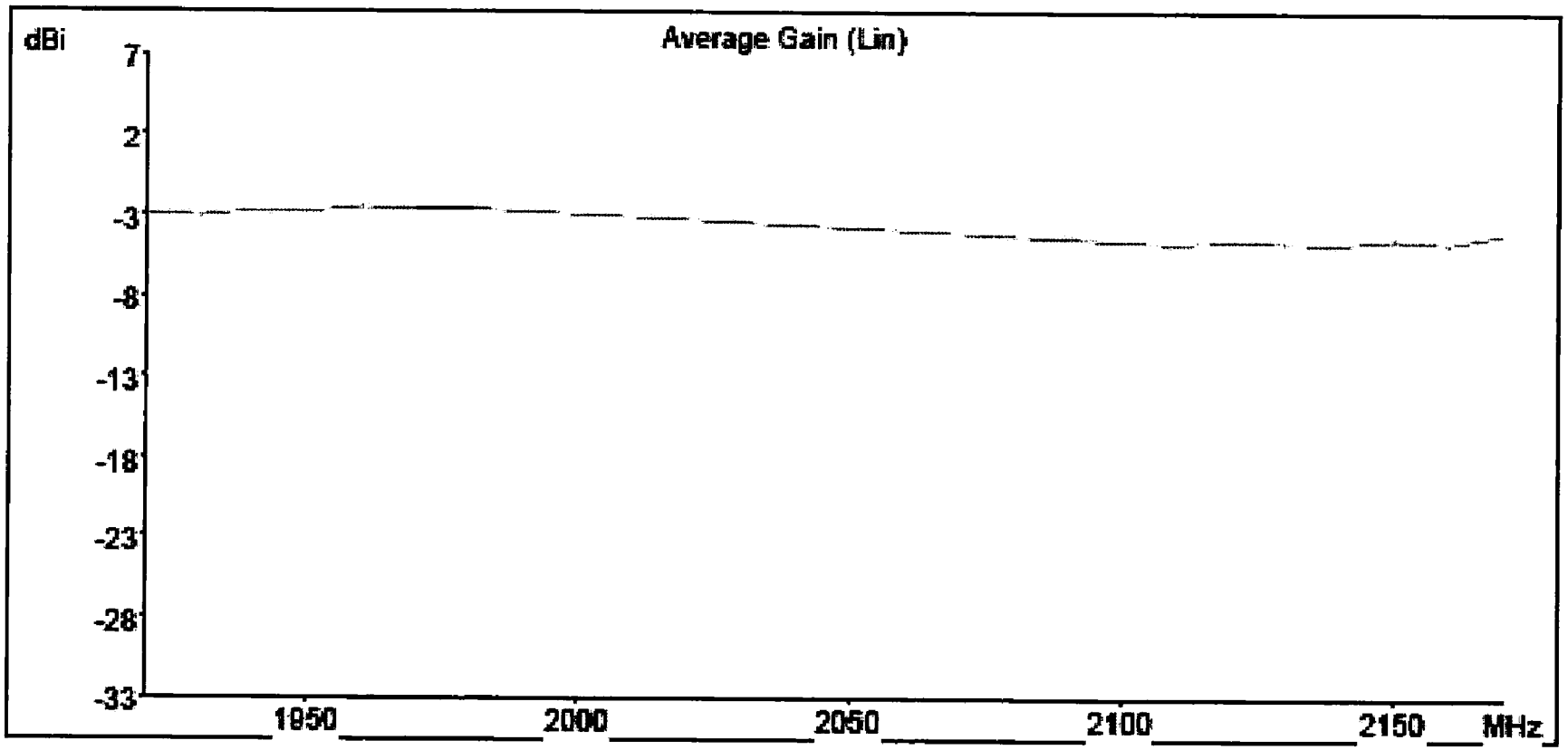

FIG. 15 is a line graph illustrating voltage standing wave ratios (VSWRs) for the exemplary antenna assembly shown in FIGS. 1 through 7 over a frequency bandwidth of about 700 MHz to about 2700 MHz and designating locations of a 2:1 VSWR over the frequency bandwidth; and FIGS. 16 through 30 illustrate radiation patterns for the exemplary antenna mast shown in FIGS. 8 through 14 for select frequencies of the AMPS system, when the antenna mast is vertically placed and electrically coupled at about the center of a one-meter diameter generally circular ground plane;

FIG. 31 is a line graph illustrating average gain at zero degrees of elevation (vertical gain) for the radiation patterns of FIGS. 16 through 30;

FIGS. 32 through 46 illustrate radiation patterns for the exemplary antenna mast shown in FIGS. 8 through 14 for select frequencies of the GSM 900 system, when the antenna mast is vertically placed and electrically coupled at about the center of a one-meter diameter generally circular ground plane;

FIG. 47 is a line graph illustrating average gain at zero degrees of elevation (vertical gain) for the radiation patterns of FIGS. 32 through 46;

FIGS. 48 through 65 illustrate radiation patterns for the exemplary antenna mast shown in FIGS. 8 through 14 for select frequencies of the GSM 1800 system, when the antenna mast is vertically placed and electrically coupled at about the center of a one-meter diameter generally circular ground plane;

FIG. 66 is a line graph illustrating average gain at zero degrees of elevation (vertical gain) for the radiation patterns of FIGS. 48 through 65;

FIGS. 67 through 80 illustrate radiation patterns for the exemplary antenna mast shown in FIGS. 8 through 14 for select frequencies of the PCS system, when the antenna mast is vertically placed and electrically coupled at about the center of a one-meter diameter generally circular ground plane;

FIG. 81 is a line graph illustrating average gain at zero degrees of elevation (vertical gain) for the radiation patterns of FIGS. 67 through 80;

FIGS. 82 through 95 illustrate radiation patterns for the exemplary antenna mast shown in FIGS. 8 through 14 for select frequencies of the UMTS system, when the antenna mast is vertically placed and electrically coupled at about the center of a one-meter diameter generally circular ground plane; and FIG. 96 is a line graph illustrating average gain at zero degrees of elevation (vertical gain) for the radiation patterns of FIGS. 82 through 95.

DETAILED DESCRIPTION

The following description is merely exemplary in nature and is not intended to limit the present disclosure, application, or use. It should be understood that throughout the drawings, corresponding reference numerals indicate like or corresponding parts and features.

Figure 1:
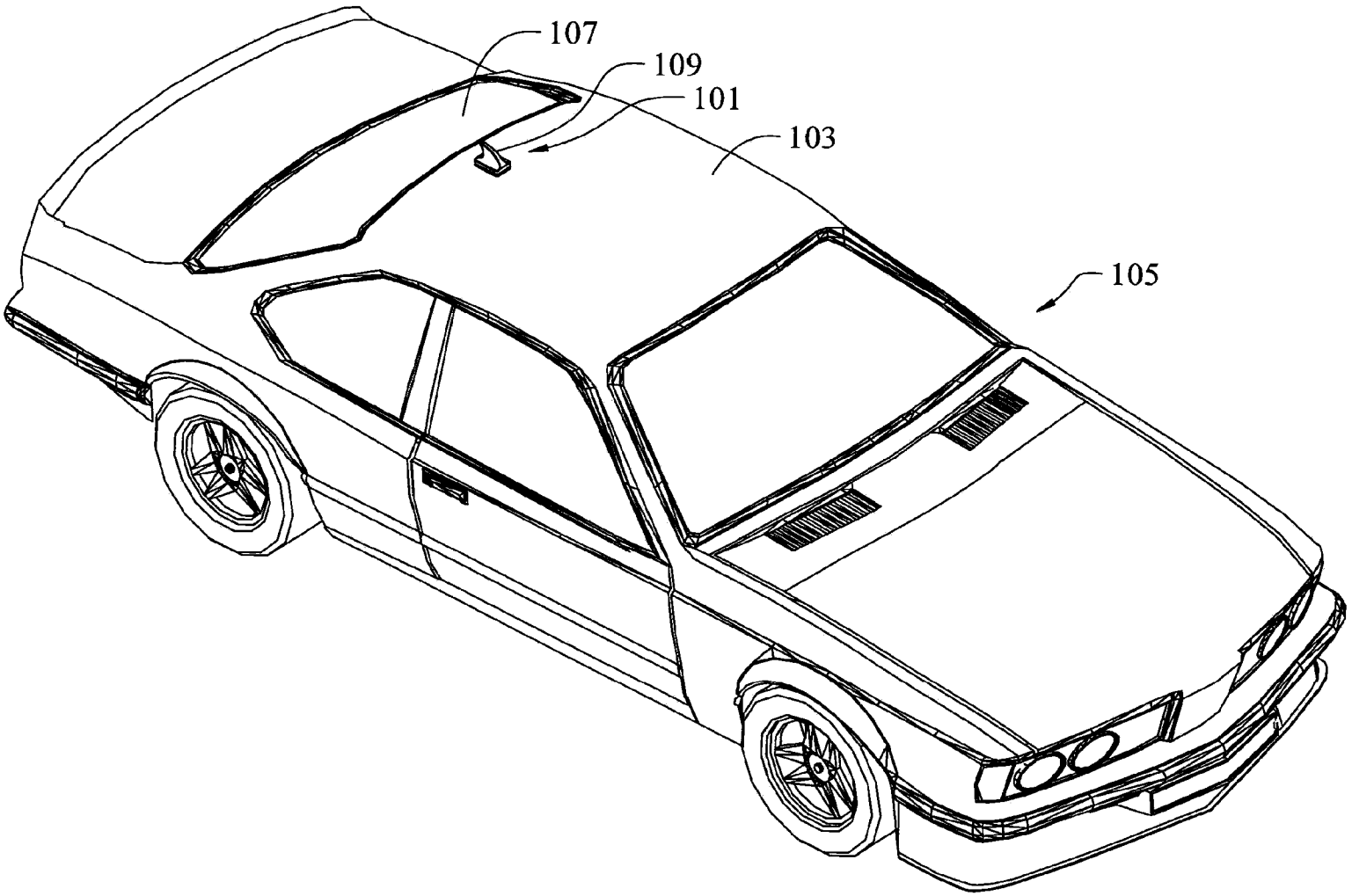
FIG. 1 is a perspective view of an antenna assembly according to an exemplary embodiment installed to a roof of a motor vehicle.
Figure 2:
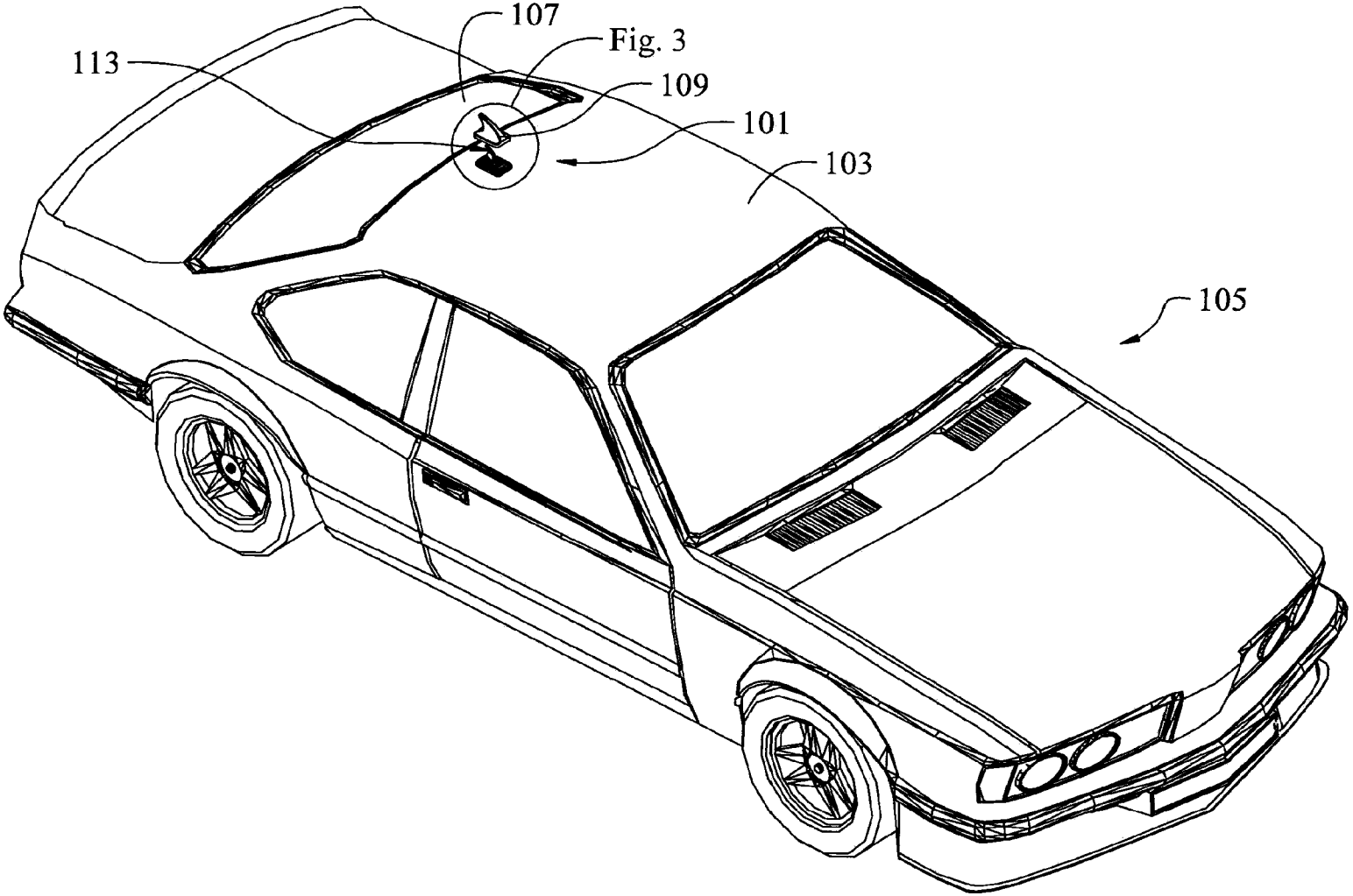
FIG. 2 is the perspective view of the antenna assembly shown in FIG. 1 with a cover of the antenna assembly exploded from the antenna assembly to illustrate an antenna mast thereof.
Figure 3:
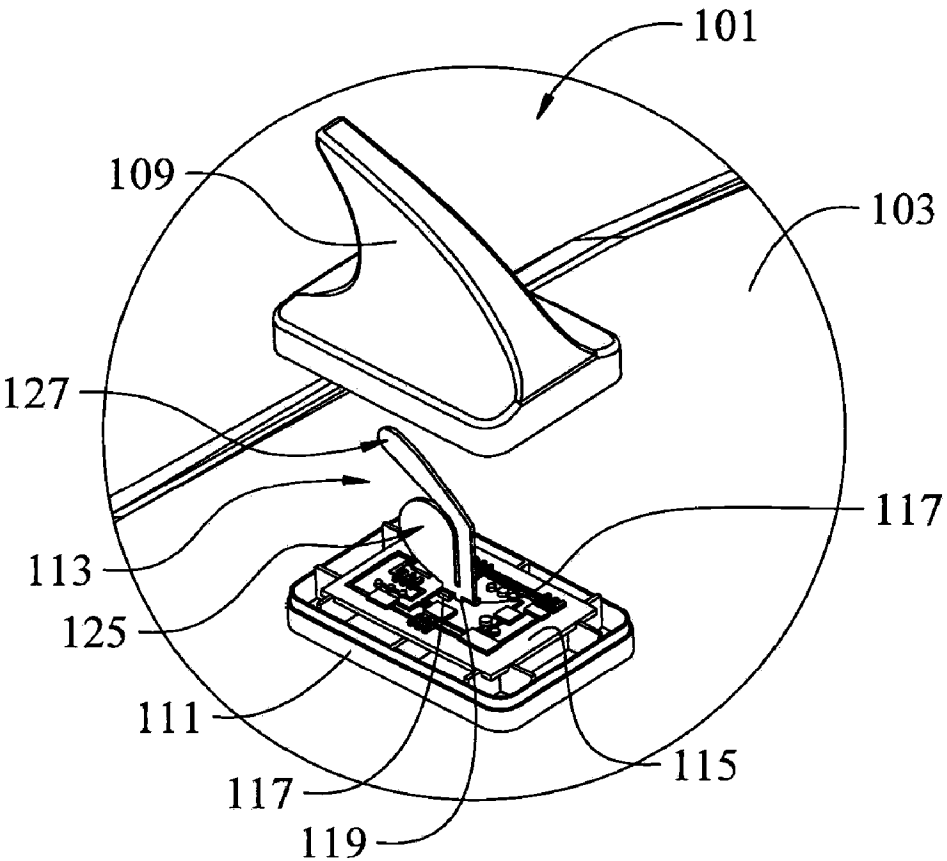
FIG. 3 is another perspective view of the antenna assembly shown in FIG. 2.
Figure 7:
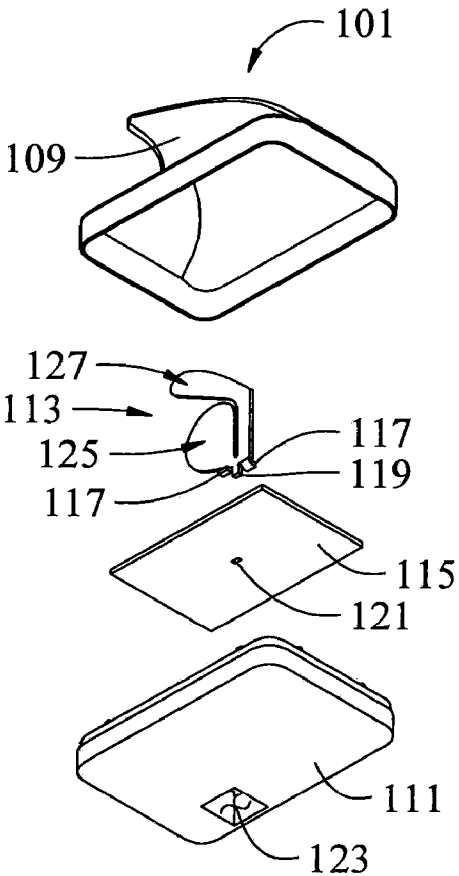
FIG. 7 is an exploded lower perspective view of the antenna assembly shown in FIG. 5.
Figure 6:
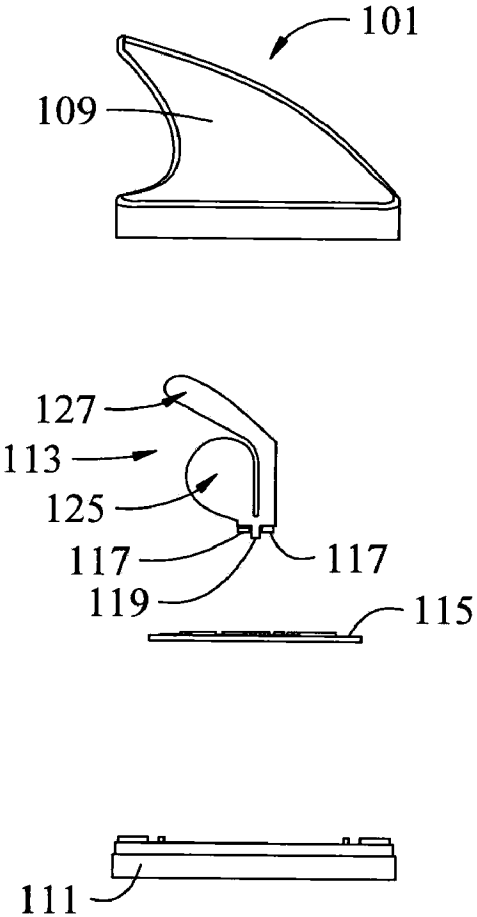
FIG. 6 is an exploded side elevation view of the antenna assembly shown in FIG. 5.
Figure 5:
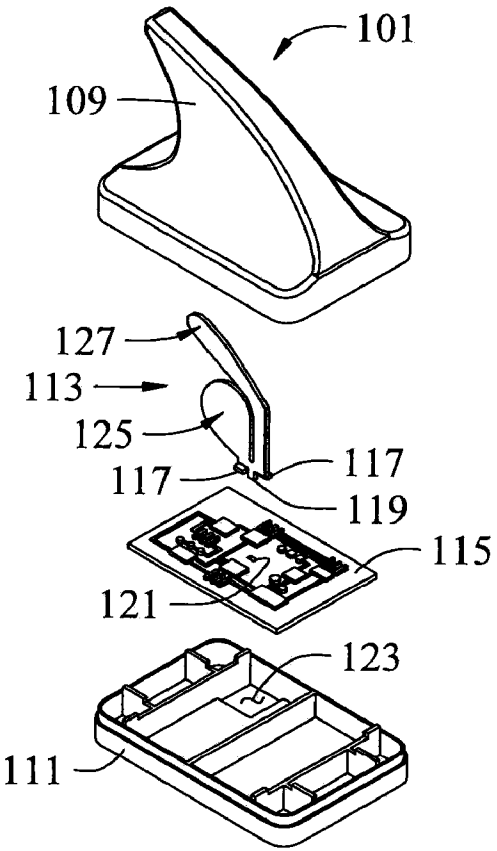
FIG. 5 is an exploded perspective view of the antenna assembly shown in FIG. 3, and further illustrating the relationship between a chassis, printed circuit board, antenna mast, and cover of the antenna assembly.

With reference now to the drawings, FIGS. 1 through 3 illustrate an exemplary antenna assembly 101 installed to a roof 103 of a motor vehicle 105, and embodying one or more aspects of the present disclosure. In other exemplary embodiments, the antenna assembly 101 may be installed at other locations, such as on a trunk of a motor vehicle, etc. In still other exemplary embodiments, the antenna assembly 101 may be installed to other mobile platforms, such as a bus, truck, boat, etc.

As shown in FIG. 1, the antenna assembly 101 is mounted on the roof 103 of the vehicle 105 toward a rear window 107 of the vehicle. In one exemplary embodiment, the assembly 101 is mounted about one hundred fifty millimeters forward of the rear window 107 along a longitudinal centerline of the roof 103. In other exemplary embodiments, the assembly 101 may be mounted more than or less than one hundred fifty millimeters from the rear window 107, and/or the assembly 101 may be mounted askew of the roof's longitudinal centerline.

A cover 109 helps protect the components of the assembly 101 enclosed within the cover against ingress of contaminants (e.g., dust, moisture, etc.) into the interior enclosure. In the illustrated embodiment, the components within the cover 109 are substantially sealed by the cover. The cover 109 may also provide an aesthetically pleasing appearance to the assembly 101, and be configured with an aerodynamic configuration. The cover 109 may be formed from a wide range of materials, such as polymers, urethanes, plastic materials (e.g., polycarbonate blends, Polycarbonate-Acrylnitril-Butadien-Styrol-Copolymer (PC/ABS) blend, etc.), glass-reinforced plastic materials, synthetic resin materials, thermoplastic materials (e.g., GE Plastics Geloy® XP4034 Resin, etc.), among other suitable materials.

As shown in FIGS. 2 and 3, the antenna assembly 101 includes a chassis 111 (broadly, a support member), which is mountable to the roof 103 of the vehicle 105. The antenna assembly 101 also includes an antenna mast 113 connected to the chassis 111. In the illustrated embodiment, the cover 109 fits over the antenna mast 113 and secures to the chassis 111. In some exemplary embodiments, the cover 109 may snap fit to the chassis 111. In other exemplary embodiments, mechanical fasteners (e.g., screws, other fastening devices, etc.) may be used for securing the cover 109 to the chassis 111. In still other exemplary embodiments, the cover 109 may connect directly to the roof 103 of the vehicle 105. Alternative embodiments may include other means for attaching the cover 109 to the chassis 111 or vehicle roof 103, such as ultrasonic welding, solvent welding, heat staking, latching, bayonet connections, hook connections, integrated fastening features, etc. Still other alternative embodiments may include a cover shaped differently than illustrated herein. In addition, the chassis 111 may be formed from materials similar to those used to form the cover 109. Alternatively, the chassis 111 may be formed from steel, zinc, or other material (including composites) by a suitable forming process, for example, a die cast process.

In some exemplary embodiments, a sealing member (e.g., O-ring, resiliently compressible elastomeric or foam gasket, etc.) may be provided between the chassis 111 and the roof 103 of the vehicle 105 for substantially sealing the chassis against the roof. A sealing member may also be provided between the cover 109 and the chassis 111 for substantially sealing the cover against the chassis.

As show in FIGS. 3 and 5-7, the illustrated antenna mast 113 connects to a printed circuit board (PCB) 115, such as a double-sided PCB. The PCB 115 is supported by the chassis 111 and is connected to the antenna mast 113 by, for example, soldering. For example, the antenna mast 113 having bent or formed tabs 117, which may provide area for soldering the antenna mast 113 to the PCB 115. The antenna mast 113 may also include a downwardly extending projection 119 that may be at least partially received within a corresponding opening 121 in the PCB 115, for example, to make electrical connection to a PCB component on the opposite side of the PCB 115. Alternatively, other embodiments may include other means for soldering or connecting the antenna mast 113 to the PCB 115.

In some exemplary embodiments, an electrical connector (not shown) may be attached to the PCB 115 for coupling the antenna mast 113 to a suitable communication link (e.g., coaxial cable, etc.) in the vehicle 105 through opening 123 in the chassis 111. In this way, the PCB 115 may receive signal input from the antenna mast 113, process the signal input, and/transmit the processed signal input to a suitable communication link. Alternatively, or in addition, the PCB 115 may process signal input to be transmitted via or through the antenna mast 113. With this said, it is understood that that the antenna mast may receive and/or transmit radio signals. In some of these embodiments, the electrical connector may be an ISO (International Standards Organization) standard electrical connector or a Fakra connector attached to the PCB 115. Accordingly, a coaxial cable (or other suitable communication link) may be relatively easily connected to the electrical connector and used for communicating signals received by the antenna mast 113 to another device, such as a cell phone receiver, in the vehicle 105. In such embodiments, the use of standard ISO electrical connectors or Fakra connectors may allow for reduced costs as compared to those antenna installations that require a customized design and tooling for the electrical connection between the antenna assembly 101 and cable. In addition, the pluggable electrical connections between the communication link and the antenna assembly's electrical connector may be accomplished by the installer without the installer having to complexly route wiring or cabling through the vehicle body wall. Accordingly, the pluggable electrical connection may be easily accomplished without requiring any particular technical and/or skilled operations on the part of the installer. Alternative embodiments may include using other types of electrical connectors and communication links (e.g., pig tail connections, etc.) besides standard ISO electrical connectors, Fakra connectors, and coaxial cables.

Figure 4:
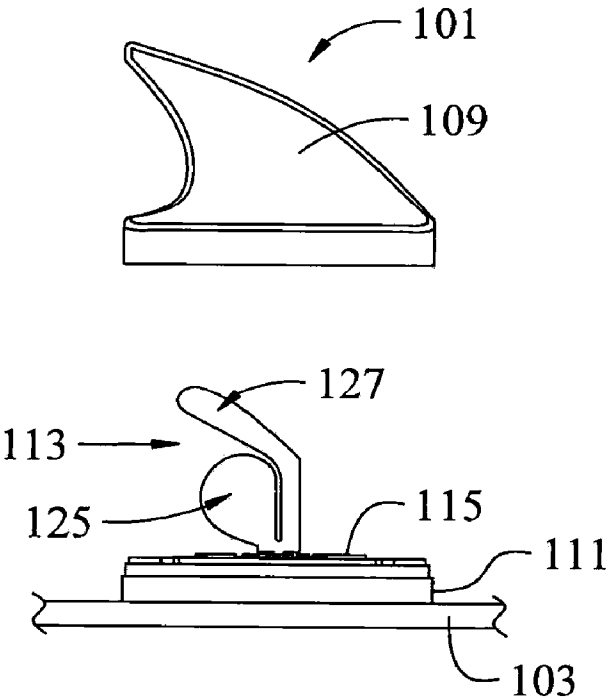
FIG. 4 is a side elevation view of the antenna assembly shown in FIG. 3.

As can be seen in FIG. 4, the antenna mast 113 includes two coplanar conductors 125 and 127 (or radiating elements) joined at a base portion 129 of the antenna mast and disposed at a predetermined height above the roof 103 of the vehicle 105. The conductors 125 and 127 extend generally vertically away from the roof 103, where the roof serves as a ground plane for the mounted antenna mast 113 for improving signal reception. Due to the size of the roof 103, the ground plane provided thereby would not be considered negligible compared to the operating wavelength of the antenna mast 113. In comparison, a ground plane associated with antennas for hand-held cell phones is usually negligible.

In the illustrated embodiment, the base portion 129 and joined conductors 125 and 127 are disposed about seven millimeters above the roof 103 of the vehicle 105 (e.g., the chassis 111 may support the PCB 115 about 6.2 millimeters above the roof, and the PCB 115 may be about 0.8 millimeters thick). In other exemplary embodiments, the base portion 129 and joined conductors 125 and 127 may be disposed more than or less than about seven millimeters above the roof 103 of the vehicle 105.

With reference now to the antenna mast 113 as shown FIGS. 8 through 14, it can be seen that a first conductor 125 is generally bulbous in shape, and a second conductor 127 is generally arcuate and elongate in shape. The second conductor 127 includes first and second elongate portions 131 and 133. The first elongate portion 131 joins to a lower portion of the first conductor 125 at the base portion 129 and extends generally along a first edge 135 of the first conductor. An open slot 137 is defined between the first and second conductors 125 and 127 for partitioning or separating them. The open slot 137 is preferably configured to provide impedance matching. Having matched impedance generally improves the power transfer for the antenna assembly 101. Conversely, antenna assemblies with mismatched impedance tend to have higher voltage standing wave ratios (VSWRs) and reduced power transfer, and thus lower gain. In various embodiments disclosed herein, impedance matching for the antenna assembly 101 is accomplished or provided by the open slot 137, as compared to those existing antenna assemblies whereby the impedance matching is provided by a PCB.

Figure 9:
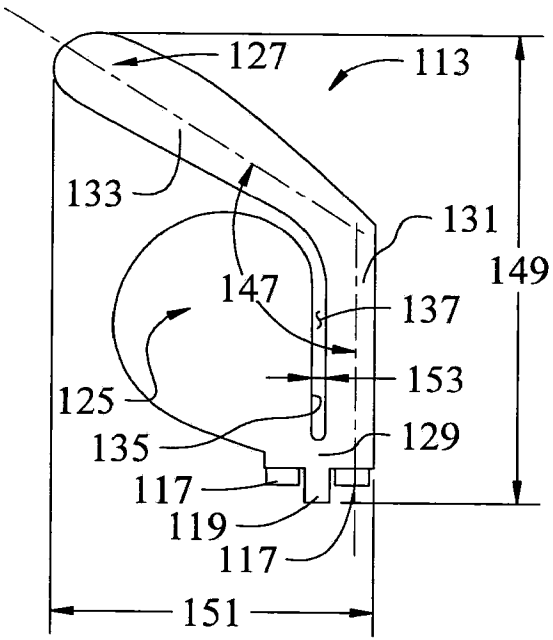
FIG. 9 is a left side elevation view of the antenna mast shown in FIG. 8.
Figure 8:
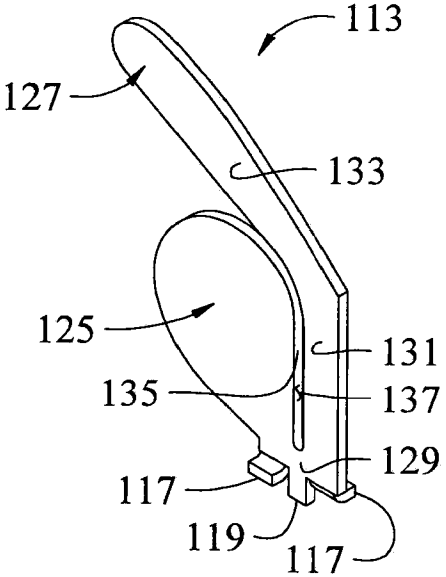
FIG. 8 is a perspective view of the antenna mast of the antenna assembly shown in FIGS. 1 through 7.
Figure 12:
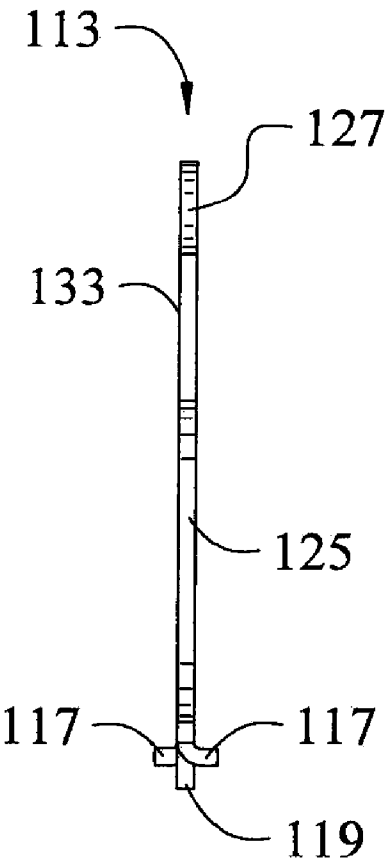
FIG. 12 is a rearward end elevation view of the antenna mast shown in FIG. 8.
Figure 11:
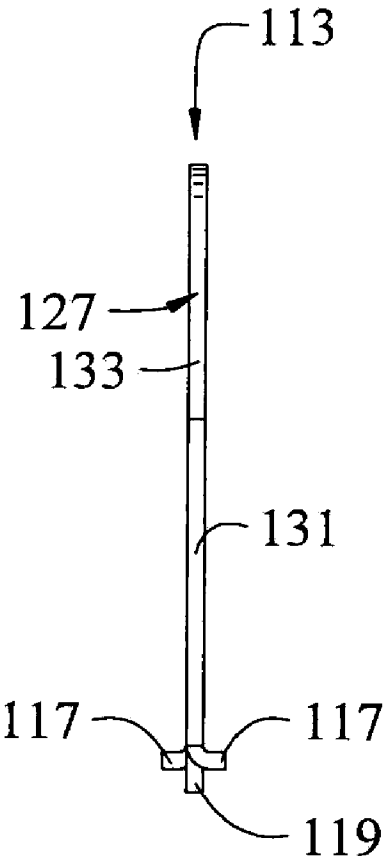
FIG. 11 is a forward end elevation view of the antenna mast shown in FIG. 8.
Figure 13:
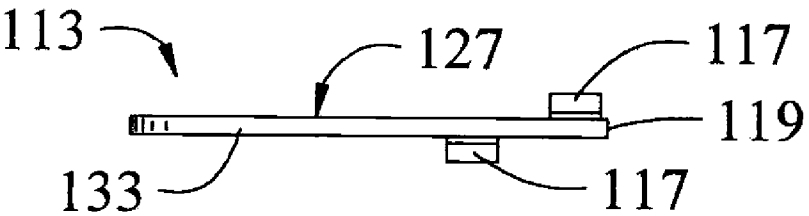
FIG. 13 is a top plan view of the antenna mast shown in FIG. 8.
Figure 14:
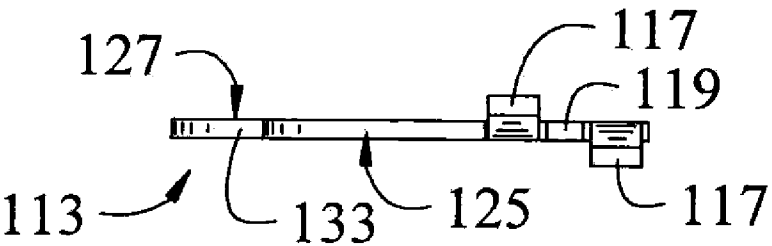
FIG. 14 is a bottom plan view of the antenna mast shown in FIG. 8.

The second elongate portion 133 of the second conductor 127 extends from the first elongate portion 131 such that an obtuse angle 147 is defined between the first and second elongate portions 131 and 133, giving the second conductor 127 its generally arcuate shape (see, for example, FIG. 9). The second portion 133 continues to extend generally along the first edge 135 of the first conductor 125 so that the open slot 137 is still generally defined therebetween. The second portion 133 extends generally over and across the width of the first conductor 125 where it terminates, providing a configuration in which the second conductor 127 extends partly around the first conductor 125 adjacent the first edge 135 of the first conductor.

Figure 10:
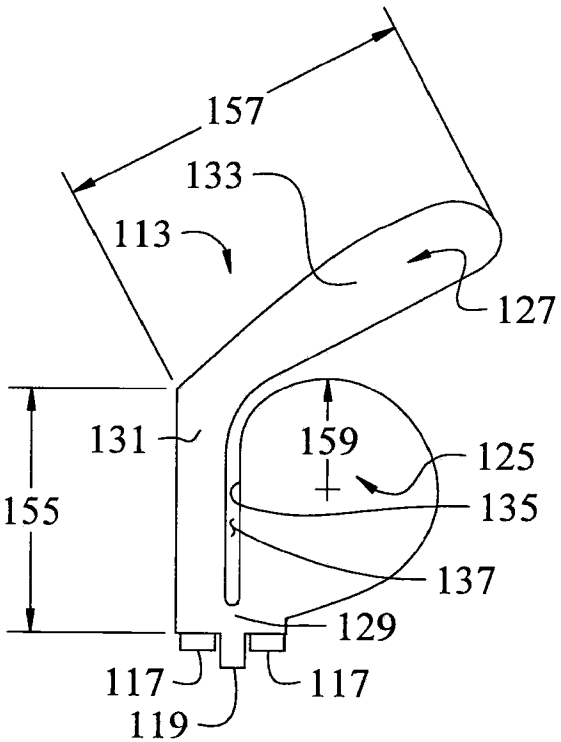
FIG. 10 is a right side elevation view of the antenna mast shown in FIG. 8.

With reference to FIGS. 9 and 10, the illustrated antenna mast 113 is sized dimensionally such that it has an overall vertical height 149 of about fifty-seven millimeters and an overall width 151 of about forty-one millimeters. The open slot 137 (separating the first conductor 125 and second conductor 127) is dimensionally sized such that the open slot 137 has a width 153 of about two millimeters. In some exemplary embodiments, the antenna mast 113 may have a vertical height that is less than or greater than about fifty-seven millimeters and/or a width that is less than or greater than about forty-one millimeters. In addition, other embodiments may include two or more conductors separated by an open slot having a width that is less than or greater than about two millimeters. In other exemplary embodiments, the first elongate portion of the second conductor may be sized dimensionally to have a length 155 of about twenty-nine millimeters, and the second elongate portion may be sized dimensionally to have a length 157 of about forty-four millimeters. In still other exemplary embodiments, the bulbous first conductor may have a radial dimension 159 of about twelve millimeters. In further exemplary embodiments, the obtuse angle 147 formed by the first and second elongate portions 131 and 133 of the second conductor 127 may be about one hundred twenty-five degrees. Other exemplary embodiments may have first and second conductors with different dimensions. The dimensions provided in this paragraph (as are all dimensions disclosed herein) are for purposes of illustration only and not for purposes of limitation.

The bulbous first conductor 125 is preferably tuned to receive electrical resonance frequencies over a bandwidth ranging from about 1650 MHz to about 2700 MHz, including those frequencies associated with the GSM 1800, PCS, GSM 1900, and UMTS systems. The elongate second conductor 127 is preferably tuned to receive electrical resonance frequencies over a bandwidth ranging from about 800 MHz to about 1000 MHz, including those frequencies associated with the AMPS, GSM 850, and GSM 900 systems. Accordingly, the disclosed antenna mast 113 is tuned for operating at frequencies within two distinct or non-overlapping bandwidths. That is, the disclosed antenna mast 113 is tuned for operating at frequencies within one bandwidth ranging from about 800 MHz to about 1000 MHz, but the disclosed antenna mast 113 is also tuned for operating at frequencies within another bandwidth ranging from about 1650 MHz to about 2700 MHz. It should now be appreciated that the disclosed antenna mast 113 is capable of ultra-wideband operation, receiving bands of radio frequencies substantially covering the different cellular network standards currently in use, such as AMPS, GSM 900, GSM 1800, PCS, UMTS, WiFi, WiMax, etc. In other exemplary embodiments, an antenna mast may be tuned for operating at frequencies within a first bandwidth ranging from about 850 MHz to about 950 MHz and at frequencies within a second bandwidth of about 1700 MHz to about 2650 MHz.

With continued reference to FIGS. 8 through 14, the antenna mast 113 is relatively thin and generally planar. The antenna mast 113 is preferably formed by a stamping process using, for example, a press tool to punch the desired antenna mast shape from a sheet of material. The stamping process monolithically or integrally forms the first and second conductors of the antenna mast 113 as one piece of material. The sheet of material may be prepared from 25-gauge thickness AISI 1006 steel. In other exemplary embodiments, the sheet of material may be prepared from materials including copper, brass, tin, silver, gold, etc., or other suitable electrically-conductive material. In still other exemplary embodiments, conductors may be formed individually and then separately attached to a base portion for installation to the roof 103 of the vehicle 105, or any other suitable mounting location.

In the illustrated embodiment, the antenna assembly 101 is installed to the roof 103 of the vehicle 105 so that the antenna mast 113 is oriented generally vertically and generally perpendicularly to the roof. The roof 103 serves as a ground plane for the antenna mast 113 and improves reception of radio signals. Particularly, the relatively large size of the ground plane (e.g., roof 103, etc.) improves reception of radio signals having generally lower frequencies. And, the large size of the ground plane (e.g., roof 103, etc.) would not be considered negligible compared to the operating wavelength of the antenna mast 113.

Because the antenna mast 113 is substantially fixed in its vertical position, vertical gain is an important characteristic as it represents the ability of the antenna mast 113 to receive cellular signals from substantially vertically overhead. In particular, the average vertical gain of an antenna mast as measured at zero degrees, five degrees, and ten degrees from the azimuth plane or the horizon from a vehicle point of view tends to be important in the automotive industry because at these angles the antenna mast would receive and/or transmit signals to cell phone repeaters at a far away distance. Antenna masts with larger average vertical gains are desirable. More particularly, antenna masts with average vertical gains within 3 dB (decibels) of the corresponding measured gain of a one-quarter wavelength monopole antenna is desirable. The monopole antenna mast 113 disclosed herein provides improved average vertical gain performance and vertically polarized gain at lower elevation angles (e.g., zero degrees to thirty degrees from the azimuth plane or horizon from the vehicle point of view) as compared to microstrip-type antennas.

For the exemplary antenna mast 113, the average vertical gain is about negative five dBi (decibels relative to isotropic) or higher at frequencies within the bandwidths ranging from about 800 MHz to about 1000 MHz and from about 1650 MHz to about 2700 MHz as determined at an elevation angle of about zero degrees from the azimuth plane or the horizon from a vehicle point of view. In some embodiments, the antenna mast 113 may have an average vertical gain as high as four dBi within the bandwidths ranging from about 800 MHz to about 1000 MHz and from about 1650 MHz to about 2700 MHz as measured at an elevation angles within a range from about twenty-five degrees to about thirty-five degrees.

Figure 32:
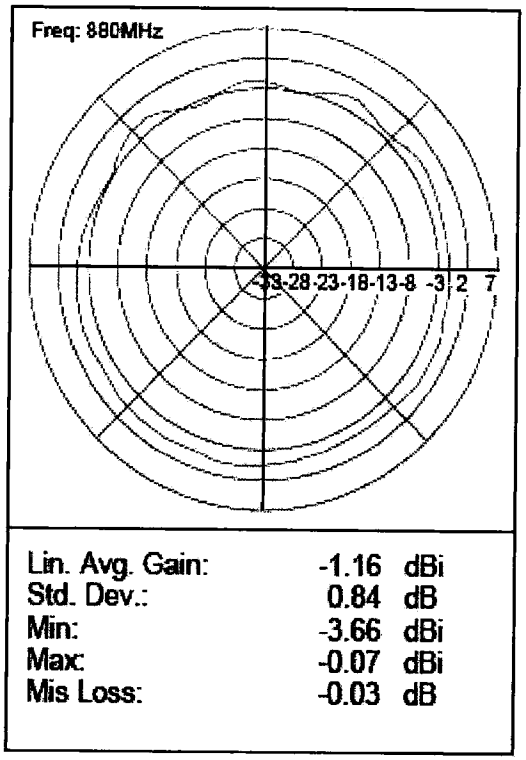
Figure 33:
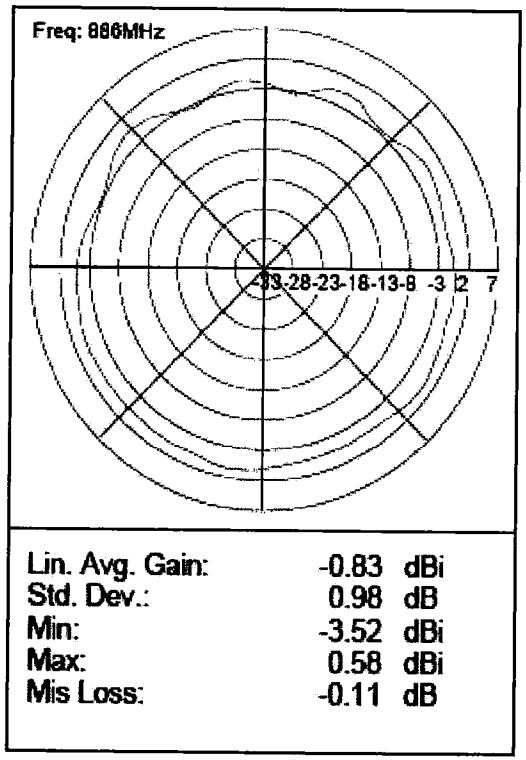
Figure 34:
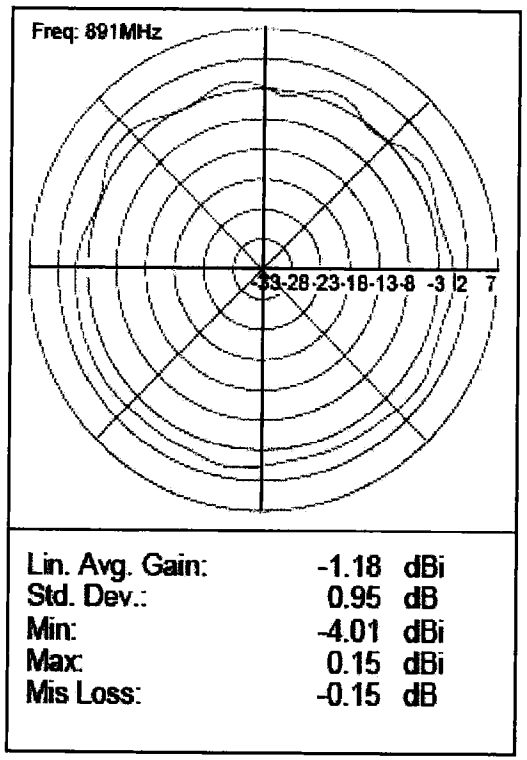
Figure 35:
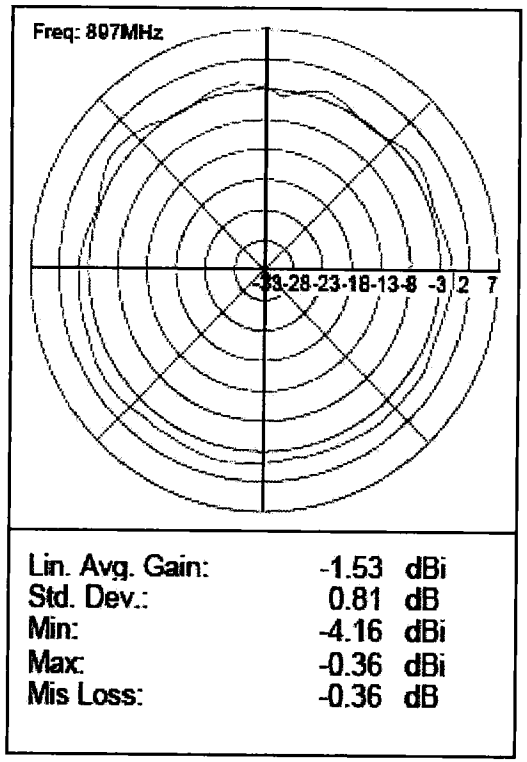
Figure 36:
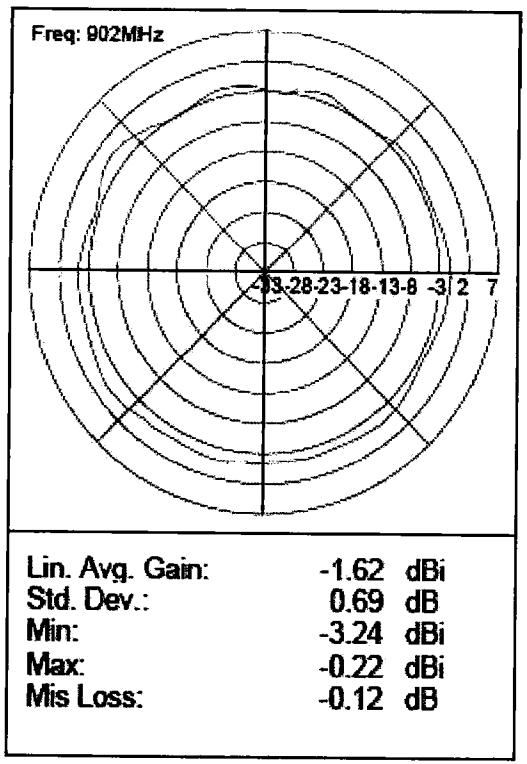
Figure 37:
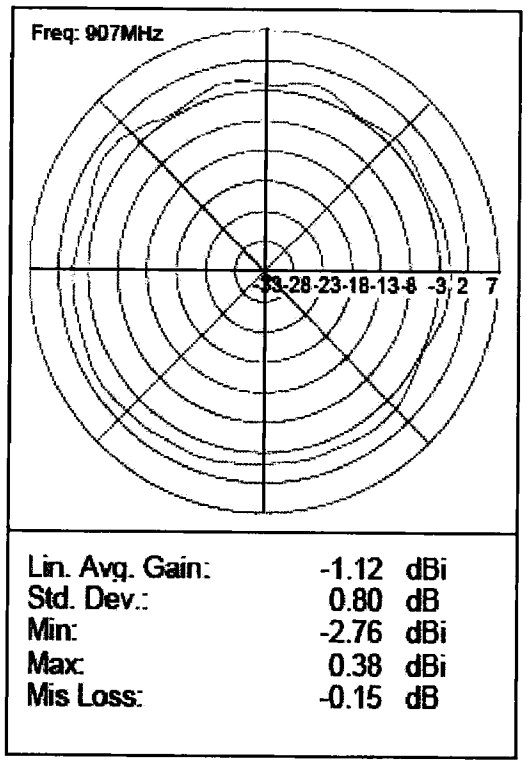
Figure 38:
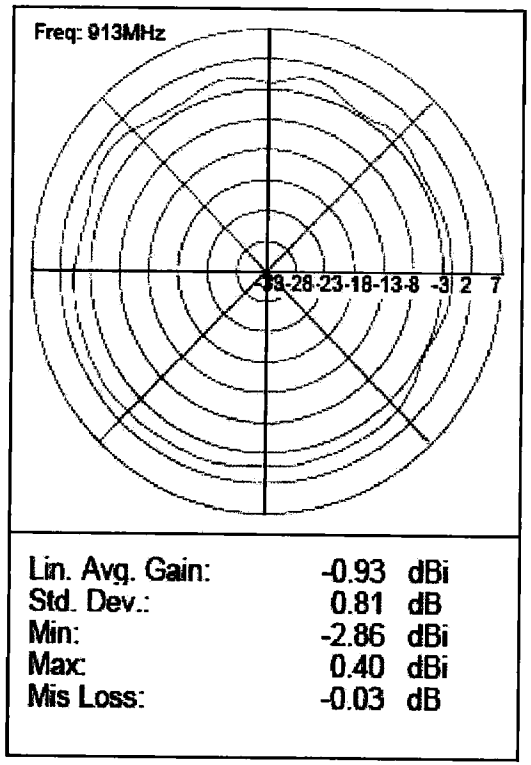
Figure 39:
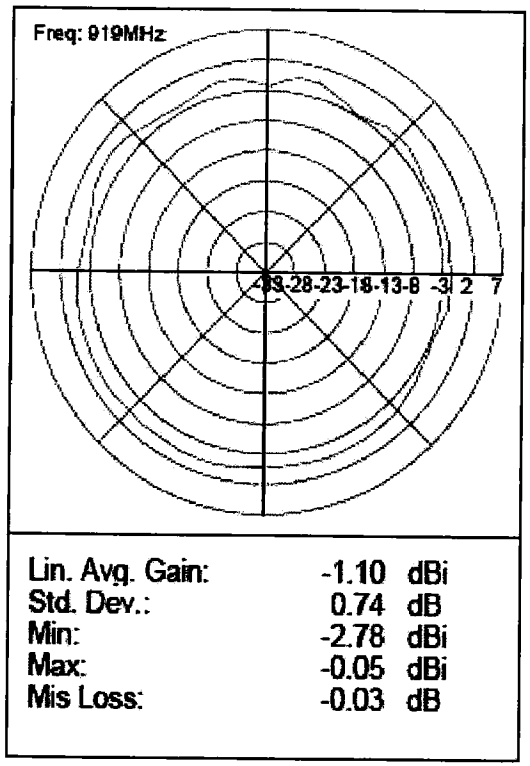
Figure 40:
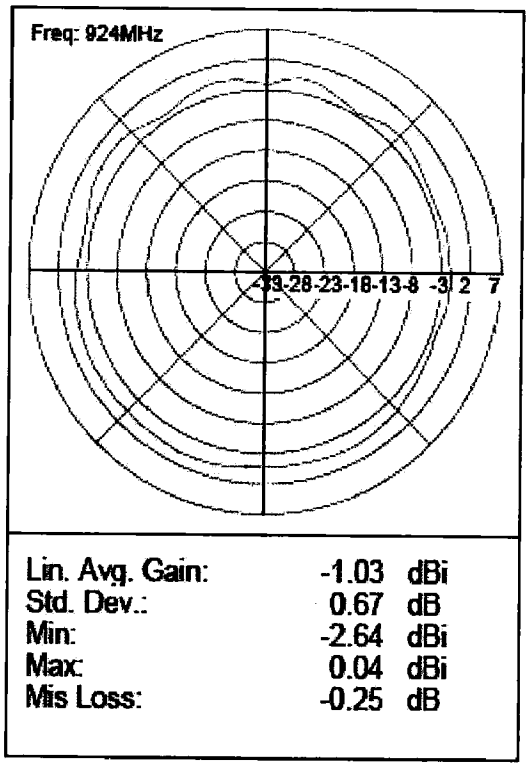
Figure 41:
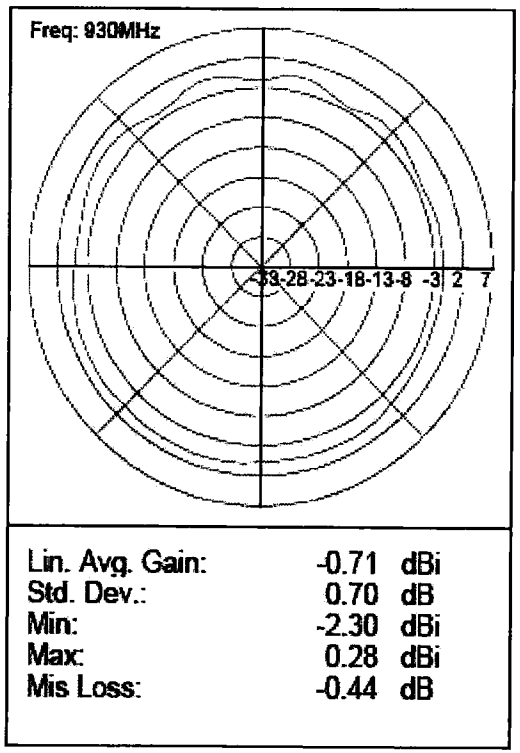
Figure 42:
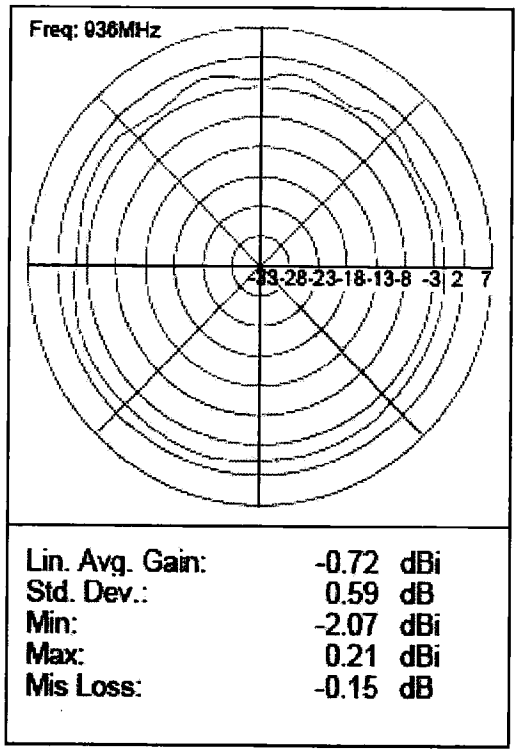
Figure 43:
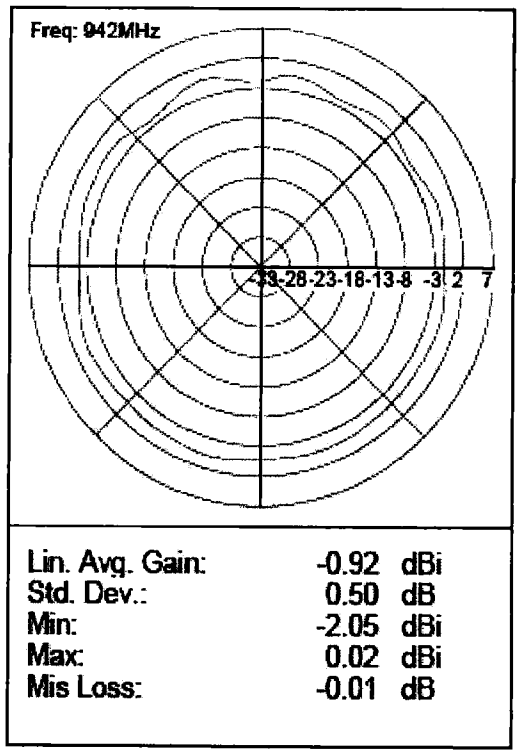
Figure 44:
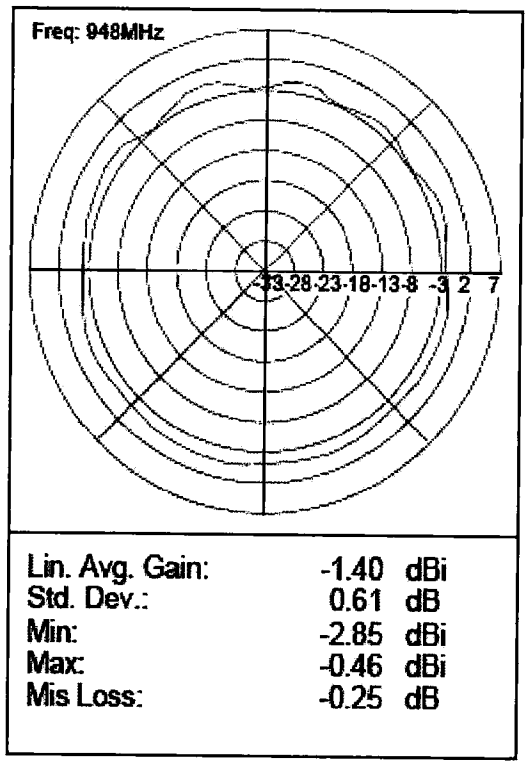
Figure 45:
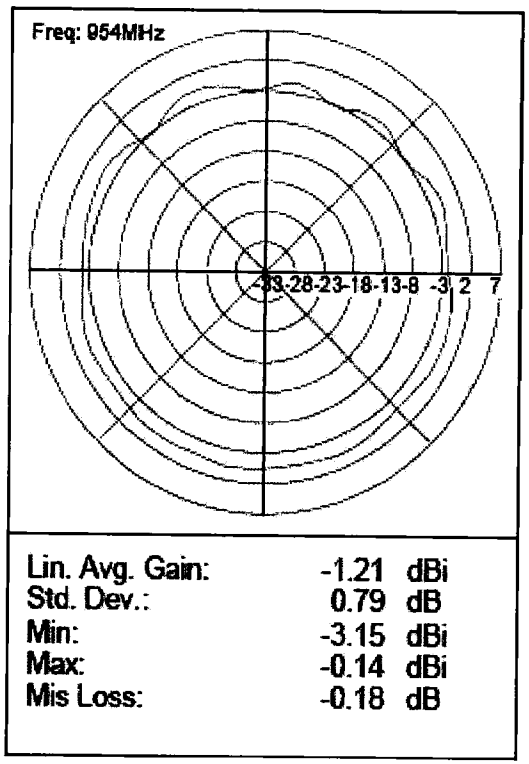
Figure 46:
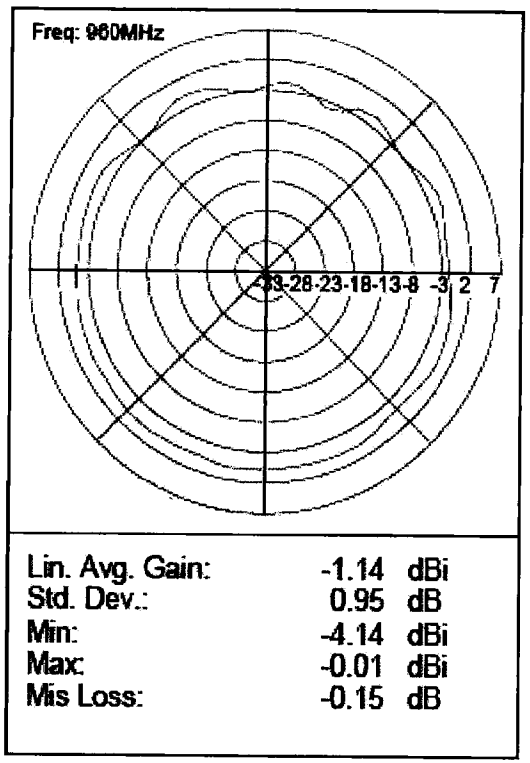

FIGS. 32 through 95 illustrate average vertical gain measurements for the antenna mast 113 (FIGS. 8 through 14) when the antenna mast 113 is vertically placed and electrically coupled at about the center of a one-meter diameter generally circular ground plane. FIGS. 32 through 46 illustrate radiation patterns for the exemplary antenna mast 113 for select frequencies of the GSM 900 system. FIG. 47 is a line graph illustrating the average gain at zero degrees of elevation (vertical gain) for the radiation patterns of FIGS. 32 through 46. FIGS. 48 through 65 illustrate radiation patterns for the exemplary antenna mast 113 for select frequencies of the GSM 1800 system. FIG. 66 is a line graph illustrating average gain at zero degrees of elevation (vertical gain) for the radiation patterns of FIGS. 48 through 65. FIGS. 67 through 80 illustrate radiation patterns for the exemplary antenna mast 113 for select frequencies of the PCS system. FIG. 81 is a line graph illustrating average gain at zero degrees of elevation (vertical gain) for the radiation patterns of FIGS. 67 through 80. FIGS. 82 through 95 illustrate radiation patterns for the exemplary antenna mast 113 for select frequencies of the UMTS system. FIG. 96 is a line graph illustrating average gain at zero degrees of elevation (vertical gain) for the radiation patterns of FIGS. 82 through 95.

Voltage standing wave ratio (VSWR) is another measurable characteristic of antenna masts of antenna assemblies that can be used to indicate reception quality. The VSWR indicates interference caused by reflected waves and may serve as an indicator of reflected waves bouncing back and forth within the transmission line connecting the antenna mast 113 to the communication link inside the vehicle 105. VSWR is generally most important when an antenna mast is used in the transmission mode for uplinks. In such situations, one would want to minimize (or at least reduce) the power reflected back to the transmitter to help protect the receiver from damage or degradation in performance. In theory, a 1:1 VSWR represents a perfect match of the antenna elements. But in practice, a 2:1 VSWR is acceptable. Higher VSWR ratios may indicate a degradation of signal reception by an antenna mast.

With reference now to FIG. 15, VSWR is illustrated in graph 141 by graphed line 143 for the exemplary antenna assembly 101 over a frequency bandwidth of about 700 MHz to about 2700 MHz as measured or determined with the antenna mast 113 placed generally vertically at about the center of a one meter diameter circular metallic ground plane. As noted herein, the antenna assembly 101 may be mounted to the vehicle roof 103, which then operates as the ground plane for the antenna assembly 101. The vehicle roof 103 is considered an electrically large ground plane.

As shown in FIG. 15, the antenna mast 113 of the antenna assembly 101 will operate at frequencies within a bandwidth ranging from about 800 MHz to about 1000 MHz and at frequencies within a bandwidth ranging from about 1650 MHz to about 2700 MHz with a VSWR of about 2:1 or less when the antenna mast 113 is electrically coupled to an electrically large ground plane (e.g., vehicle roof 103, etc.). Reference numeral 145 indicates locations on the graph 141 having a VSWR of 2:1. Table 1 identifies some exemplary VSWR at different frequencies.

TABLE 1

Exemplary Voltage Standing Wave Ratios (VSWR)

| Frequency (MHz) | VSWR |
|---|---|
| 824 | 1.67:1 |
| 960 | 1.69:1 |
| 1710 | 1.54:1 |
| 2170 | 1.34:1 |

In other exemplary embodiments, an antenna assembly 101 may have a VSWR of about 2:1 or less at frequencies within a bandwidth ranging from about 850 MHz to about 950 MHz and at frequencies within a bandwidth ranging from about 1700 MHz to about 2650 MHz.

In still other exemplary embodiments, a wideband antenna assembly may include an stamped monopole antenna mast with two or more conductors combined to a single feed. In these exemplary embodiments, the conductors are combined at a predetermined height from the point of connection with the single feed. The conductors further have a predetermined spacing between the conductors.

In yet other exemplary embodiments, an antenna mast may receive frequencies associated with WiFi and/or Wi-Max (e.g., frequencies in the 2400 MHz band). In these embodiments, a diplexer circuit may be used to separate cell phone signals from Wi-Fi and/or Wi-max signals, both when receiving and transmitting.

In addition, various antenna assemblies (e.g., 101, etc.) and components (e.g., 109, 111, 113, 115, etc.) disclosed herein may be mounted to a wide range of supporting structures, including stationary platforms and mobile platforms. For example, an antenna assembly (e.g., 101, etc.) disclosed herein could be mounted to supporting structure of a bus, train, aircraft, bicycle, motor cycle, boat, among other mobile platforms. Accordingly, the specific references to motor vehicles or automobiles herein should not be construed as limiting the scope of the present disclosure to any specific type of supporting structure or environment.

Furthermore, various antenna assemblies (e.g., 101, etc.) disclosed herein may be used to receive, transmit, or both receive and transmit cellular signals. In some embodiments, the antenna assemblies may include a cell phone antenna (e.g., the stamped monopole antenna 113, etc.) along with (e.g., collocated within the same package, etc.) one or more antennas for further receiving Global Positioning System (GPS) signals and/or Satellite Digital Audio Radio Services (SDARS) signals. In these embodiments, the GPS and SDARS signals may be transmitted using one or more feed lines separate from a feed line transmitting cellular signals (AMPS, PCS, GSM, UMTS, WiFi, WiMax, etc.). The preferred minimum active isolation between output of a AMPS/PCS feed line and output of a GPS feed line is preferably at least about sixty dB or more for a frequency band of about 824 through 849 MHz, preferably at least about thirty-five dB or more for a frequency of about 1698 MHz, and preferably at least about forty dB or more for a frequency band of about 1850 through 1910 MHz. The preferred minimum active isolation between output of the AMPS/PCS feed line and output of a SDARS feed line is preferably at least about fifty dB or more for a frequency band of about 824 through 849 MHz and preferably at least about forty dB or more for a frequency band of about 1850 through 1990 MHz.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context. The terms "first" and "second" also do not imply or require only two of such structures. For example, various embodiments may include more than two conductors.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An antenna assembly for installation to a vehicle body wall operable as an electrically large ground plane for the antenna assembly after installation thereto, the antenna assembly comprising a stamped metal monopole antenna mast, the antenna mast including:

a first conductor tuned to at least one electrical resonant frequency for operating within a bandwidth ranging from about 800 MHz to about 1000 MHz;

a second conductor tuned to at least one electrical resonant frequency for operating within a bandwidth ranging from about 1650 MHz to about 2700 MHz;

an open slot extending at least partially between the first and second conductors to provide impedance matching;

when electrically coupled to the electrically large ground plane, the antenna mast having a voltage standing wave ratio (VSWR) of about 2:1 or less at frequencies within a bandwidth ranging from about 800 MHz to about 1000 MHz and at frequencies within a bandwidth ranging from about 1650 MHz to about 2700 MHz.

2. The antenna assembly of claim 1, wherein the antenna mast is stamped from a single sheet of material.

3. The antenna assembly of claim 1, wherein:

the first and second conductors are connected at a base portion and extend generally away from the base portion;

the first conductor is generally bulbous in shape;

the second conductor is elongate and generally arcuate in shape such that the second conductor extends partly around the first conductor; and the open slot extends from the base portion generally between the first and second conductors.

4. The antenna assembly of claim 1, wherein the antenna mast has an average vertical gain of about negative five dBi or higher at an elevation angle of about zero degrees at frequencies within a bandwidth ranging from about 800 MHz to about 1000 MHz and at frequencies within a bandwidth ranging from about 1650 MHz to about 2700 MHz.

5. The antenna assembly of claim 4, wherein the antenna mast has an average vertical gain of about four dBi at elevation angles ranging from about twenty-five degrees to about thirty-five degrees at frequencies within a bandwidth ranging from about 800 MHz to about 1000 MHz and at frequencies within a bandwidth ranging from about 1650 MHz to about 2700 MHz.

6. The antenna assembly of claim 1, further comprising:

a chassis mounted to a vehicle roof which is operable as the ground plane for the antenna assembly at frequencies at least ranging from about 800 MHz to about 1000 MHz, the chassis supporting the antenna mast above the vehicle roof such that the antenna mast extends generally vertically relative to the vehicle roof; and a printed circuit board supported by the chassis and connected to the antenna mast for operation, whereby impedance matching for the antenna assembly is provided by the open slot.

7. A stamped metal monopole antenna mast for an antenna assembly for installation to a vehicle body wall operable as an electrically large ground plane for the antenna assembly after installation thereto, the stamped metal monopole antenna mast comprising:

a first conductor tuned for receiving electrical resonant frequencies within a first frequency bandwidth;

a second conductor tuned for receiving electrical resonant frequencies within a second frequency bandwidth different than the first frequency bandwidth;

a base portion from which the first and second conductors extend generally away; and an open slot extending from the base portion generally between the first and second conductors, the open slot providing impedance matching for the antenna assembly.

8. An antenna assembly including the antenna mast of claim 7, and installed to a vehicle roof such that vehicle roof is an electrically large ground plane for the antenna assembly at a lower frequency band ranging from about 800 MHz to about 1000 MHz.

9. The antenna mast of claim 7, wherein:

the first conductor is tuned for receiving signals within a bandwidth ranging from about 800 MHz to about 1000 MHz; and the second conductor is tuned for receiving signals within a bandwidth of about 1650 MHz to about 2700 MHz.

10. The antenna mast of claim 9, wherein the antenna mast has an average vertical gain of about negative five dBi or higher at an elevation angle of about zero degrees at frequencies within a bandwidth ranging from about 800 MHz to about 1000 MHz and at frequencies within a bandwidth ranging from about 1650 MHz to about 2700 MHz.

11. The antenna mast of claim 10, wherein the antenna mast has an average vertical gain of about four dBi at elevation angles ranging from about twenty-five degrees to about thirty-five degrees at frequencies within a bandwidth ranging from about 800 MHz to about 1000 MHz and at frequencies within a bandwidth ranging from about 1650 MHz to about 2700 MHz.

12. An antenna assembly including the antenna mast of claim 9, and having a voltage standing wave ratio (VSWR) of about 2:1 or less at frequencies within a bandwidth ranging from about 800 MHz to about 1000 MHz and at frequencies within a bandwidth ranging from about 1650 MHz to about 2700 MHz.

13. The antenna mast of claim 7, wherein the antenna mast is stamped from a single sheet of material.

14. The antenna mast of claim 7, wherein:

the first conductor is generally bulbous in shape;

the second conductor is elongate and generally arcuate in shape such that the second conductor extends partly around the first conductor.

15. An antenna assembly including the antenna mast of claim 7, and further comprising:

a chassis supporting the antenna mast above the vehicle body wall;

a printed circuit board supported by the chassis and connected to the antenna mast for operation.

16. The antenna assembly of claim 15, wherein impedance matching is provided solely by the open slot.

17. The antenna assembly of claim 15, wherein at least a portion of the base portion of the antenna mast is soldered to the printed circuit board.

18. The antenna assembly of claim 15, wherein the antenna mast is about seven millimeters or more above the vehicle body wall.

19. The antenna mast of claim 7, wherein the second conductor includes first and second elongate portions, the first elongate portion joined to a lower portion of the first conductor at a predetermined height above the vehicle body wall, the first elongate portion extending generally vertically upward relative to the vehicle body wall along a first edge of the first conductor, the second elongate portion extending from the first elongate portion such that an obtuse angle is defined therebetween, the second elongate portion extending from the first edge of the first conductor generally over and across the width of the first conductor.

20. A stamped metal monopole antenna mast for an antenna assembly for installation to a vehicle body wall operable as an electrically large ground plane for the antenna assembly after installation thereto, the stamped metal monopole antenna mast comprising:

a first conductor tuned to at least one electrical resonant frequency for operating within a bandwidth ranging from about 800 MHz to about 1000 MHz;

a second conductor tuned to at least one electrical resonant frequency for operating within a bandwidth of about 1650 MHz to about 2700 MHz;

an open slot extending at least partially between the first and second conductors to provide impedance matching;

the antenna mast configured to have an average vertical gain of about negative five dBi or higher at an elevation angle of about zero degrees at frequencies within the bandwidth ranging from about 800 MHz to about 1000 MHz and at frequencies within the bandwidth ranging from about 1650 MHz to about 2700 MHz.

21. The antenna mast of claim 20, wherein the antenna mast has an average vertical gain of about four dBi at elevation angles ranging from about twenty-five degrees to about thirty-five degrees at frequencies within a bandwidth ranging from about 800 MHz to about 1000 MHz and at frequencies within a bandwidth ranging from about 1650 MHz to about 2700 MHz.

22. An antenna assembly including the antenna mast of claim 20, and installed to a vehicle roof such that vehicle roof is operable as an electrically large ground plane for the antenna assembly at a lower frequency band ranging from about 800 MHz to about 1000 MHz.

23. An antenna assembly including the antenna mast of claim 20, and having a voltage standing wave ratio (VSWR) of about 2:1 or less at frequencies within a bandwidth ranging from about 800 MHz to about 1000 MHz and at frequencies within a bandwidth ranging from about 1650 MHz to about 2700 MHz.

24. The antenna mast of claim 20, wherein the antenna mast is stamped from a single sheet of material.

25. The antenna mast of claim 20, wherein:

the first conductor is generally bulbous in shape; and the second conductor is elongate and generally arcuate in shape such that the second conductor extends partly around the first conductor.

26. An antenna assembly including the antenna mast of claim 20, and further comprising:

a chassis supporting the antenna mast above the vehicle body wall;

a printed circuit board supported by the chassis and connected to the antenna mast for operation.

27. The antenna assembly of claim 26, wherein the impedance matching is provided solely by the open slot.

* * * * *